US008444108B2

(12) United States Patent
Kennedy et al.

(10) Patent No.: US 8,444,108 B2
(45) Date of Patent: May 21, 2013

(54) MINE SEAL WITH ELECTRICALLY NON-CONDUCTIVE TIES

(75) Inventors: William R. Kennedy, Taylorville, IL (US); John M. Kennedy, Taylorville, IL (US)

(73) Assignee: Kennedy Metal Products & Buildings, Inc., Taylorville, IL (US)

( * ) Notice: Subject to any disclaimer, the term of this patent is extended or adjusted under 35 U.S.C. 154(b) by 377 days.

(21) Appl. No.: 12/367,806

(22) Filed: Feb. 9, 2009

(65) Prior Publication Data

US 2009/0279955 A1 Nov. 12, 2009

Related U.S. Application Data

(60) Provisional application No. 61/052,282, filed on May 12, 2008.

(51) Int. Cl.
*E04G 17/06* (2006.01)

(52) U.S. Cl.
USPC ..... 249/40; 405/132; 249/43; 249/213; 249/216

(58) Field of Classification Search
USPC ..... 405/132, 287, 288; 249/10, 33, 40, 249/190, 219.2, 213, 216, 218, 34, 41, 42, 249/44–47, 191, 214, 215; 52/426, 442
See application file for complete search history.

(56) References Cited

U.S. PATENT DOCUMENTS

| | | | | | |
|---|---|---|---|---|---|
| 2,571,429 | A | * | 10/1951 | Dupler | 403/340 |
| 3,486,284 | A | * | 12/1969 | Sauerbrunn et al. | 52/262 |
| 3,731,902 | A | * | 5/1973 | Shoemaker | 249/210 |
| 3,734,453 | A | * | 5/1973 | Bailey | 249/213 |
| 4,006,878 | A | * | 2/1977 | Dawson et al. | 249/43 |
| 4,483,642 | A | | 11/1984 | Kennedy | |
| 4,726,560 | A | * | 2/1988 | Dotson | 249/43 |
| 5,167,474 | A | | 12/1992 | Kennedy | |
| 6,799,927 | B2 | * | 10/2004 | Wheatley | 410/104 |

OTHER PUBLICATIONS http://www.cdc.gov/niosh/mining/pubs/pdfs/lptte.pdf Oct. 2002.*
Figs. 1A and 1B from pending U.S. Appl. No. 12/367,806 show a first version of a prior art mine seal, 2 pages.
Figs. 2A-2C from pending U.S. Appl. No. 12/367,806 show a second version of a prior art mine seal, 3 pages.
Figs. 3A-3C from pending U.S. Appl. No. 12/367,806 show a third version of a prior art mine seal, 3 pages.
Figs. 4A and 4B from pending U.S. Appl. No. 12/367,806 show a fourth version of a prior art mine seal, 2 pages.
30 CFR 75.337 (B)(2) MSHA Rules, p. 502.

* cited by examiner

*Primary Examiner* — Sean Andrish
(74) *Attorney, Agent, or Firm* — Senniger Powers LLP

(57) ABSTRACT

A mine seal comprising two spaced apart walls, at least one electrically non-conductive tie extending between the walls and holding them in place against forces tending to separate the walls, and a filler material filling the space between the walls. A form for making such a mine seal is also disclosed.

12 Claims, 26 Drawing Sheets

MINE SEAL WITH ELECTRICALLY NON-CONDUCTIVE TIES

CROSS-REFERENCE TO RELATED APPLICATION

This application claims priority from U.S. Patent Application No. 61/052,282 (provisional), filed May 12, 2008, which is hereby incorporated by reference in its entirety.

FIELD OF THE INVENTION

The present invention generally relates to mine seals, and more particularly to such a seal which is resistant to the passage of electrical current through the seal.

BACKGROUND OF THE INVENTION

In particular, the present invention is an improvement on the mine seal disclosed in co-assigned U.S. Pat. No. 5,167,474 titled "Form for Making a Permanent Concrete Mine Stopping" and incorporated by reference herein for all purposes not inconsistent with this disclosure. This patent discloses a mine seal comprising two opposing spaced apart walls defined by a number of side-by-side extensible and contractible metal panels connected by horizontal ties spanning the space between the walls and by horizontal angle bars on the outside of the panels. The space between the walls is filled with full weight concrete or other suitable filler material (e.g., yieldable foamed concrete) which hardens or cures to form a permanent mine seal.

FIGS. 1-4 show four different prior art versions of a mine seal made in accordance with the invention disclosed in U.S. Pat. No. 5,167,474 which have been used commercially. In FIGS. 1A and 1B, the mine seal 1 comprises two spaced apart walls 3 made of extensible and contractible panels 5. The walls are connected by ties 9 and angle bars 15. Each tie 9 comprises a pair of end tie plates 17 connected by a metal chain 21 passing through keyhole openings 23 in the tie plates, the chain being secured in each opening by passing a link of the chain into the reduced-diameter portion of the keyhole opening 23. The tie plates 17 have V-shaped openings 27 for receiving the angle bars 15. FIGS. 2A-2C show a second variation of a mine seal 101 in which each tie 109 comprises an elongate metal plate or bar 131 having two V-shaped openings 135 adjacent opposite ends of the bar for receiving the angle bars 141. Each V-shaped opening 135 is formed by the combination of a notch 145 in a respective end of the metal bar 131 and a mating notch 147 in an end piece 151 secured by suitable fasteners 153 (e.g., rivets) to the bar. FIGS. 3A-3C show a third variation of a mine seal 201 in which each tie 209 comprises an adjustable-length elongate metal plate or bar 231 made of multiple overlapping sections 233 secured together by suitable fasteners 235 (e.g., nut-and-bolt fasteners) extending through selected aligned holes 236 in the overlapping sections. The bar 231 has two V-shaped openings 237 adjacent opposite ends of the bar for receiving the angle bars 239. Each V-shaped opening 237 is formed by the combination of a notch 245 in a respective end of the metal bar 231 and a mating notch 247 in an end piece 251 secured by suitable fasteners 253 (e.g., rivets) to the bar. FIGS. 4A-4B show a fourth variation of a mine seal 301 in which each tie 309 comprises a pair of end tie plates 341 connected by a metal rod 343 secured to the end tie plates. The end tie plates 341 have V-shaped openings 353 for receiving the angle bars 355.

In the various embodiments of the above-referenced mine seal, the ties 9, 109, 209 and 309 are of a conductive material. Recently, MSHA (Mine Safety and Health Administration of the U.S. Department of Labor) has promulgated rules prohibiting conductors through permanent seals.

SUMMARY OF THE INVENTION

In general, a mine seal of the present invention comprises a pair of spaced apart walls, at least one electrically non-conductive tie extending between the walls and holding them in place against forces tending to separate the walls, and a filler material between the walls.

In another aspect, this invention is directed to a form for making the aforementioned mine seal. The form comprises wall panels for making the spaced apart walls, and at least one electrically non-conductive tie for holding them in place.

In another aspect, this invention is directed to an electrically non-conductive tie for use in a mine seal having opposing walls defining a space for receiving filler material. The tie has opposite ends and is made at least in part from an electrically non-conductive material which extends across substantially the entire width of the tie for preventing conduction of electrical current from one end of the tie to the other. Openings are provided adjacent opposite ends of the tie for receiving wall supports for the mine seal.

Other objects and features will be in part apparent and in part pointed out hereinafter.

BRIEF DESCRIPTION OF THE DRAWINGS

Corresponding reference characters indicate corresponding parts throughout the drawings.

DESCRIPTION OF THE PREFERRED EMBODIMENTS

Figure 1A:
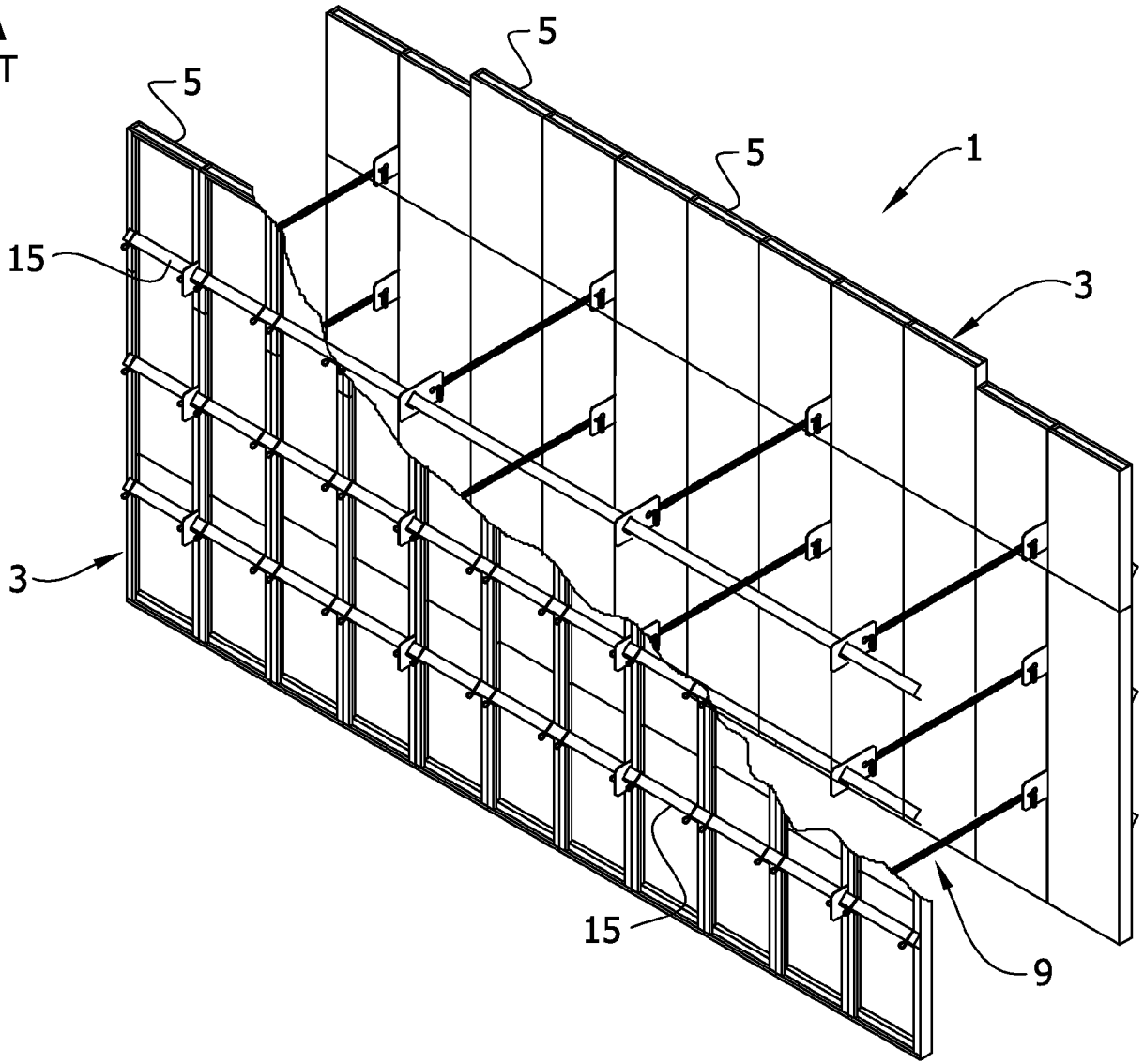
FIG. 1A PRIOR ART
FIGS. 1A and 1B show a first version of a prior art mine seal.
Figure 1B:
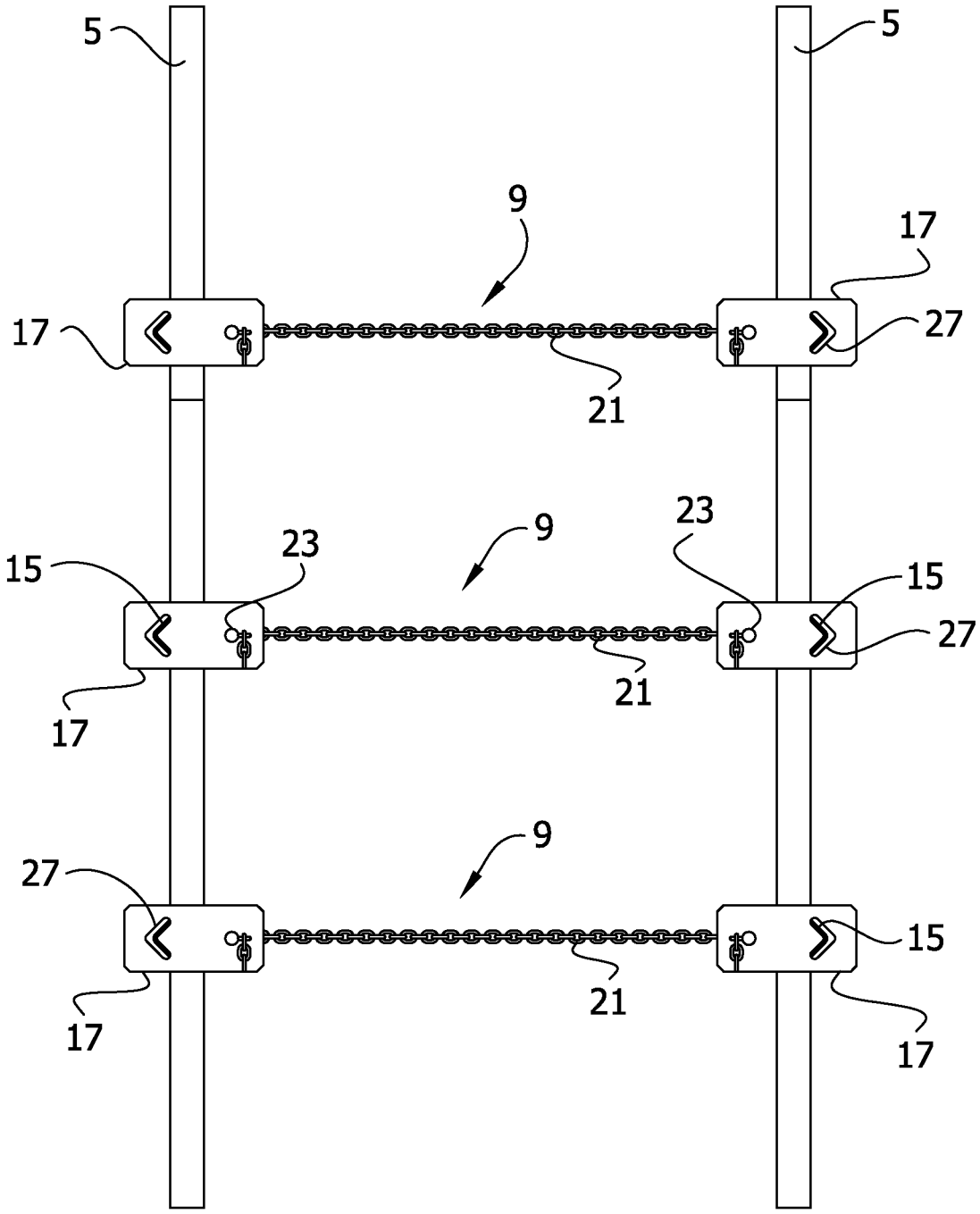
FIG. 1B PRIOR ART
Figure 2A:
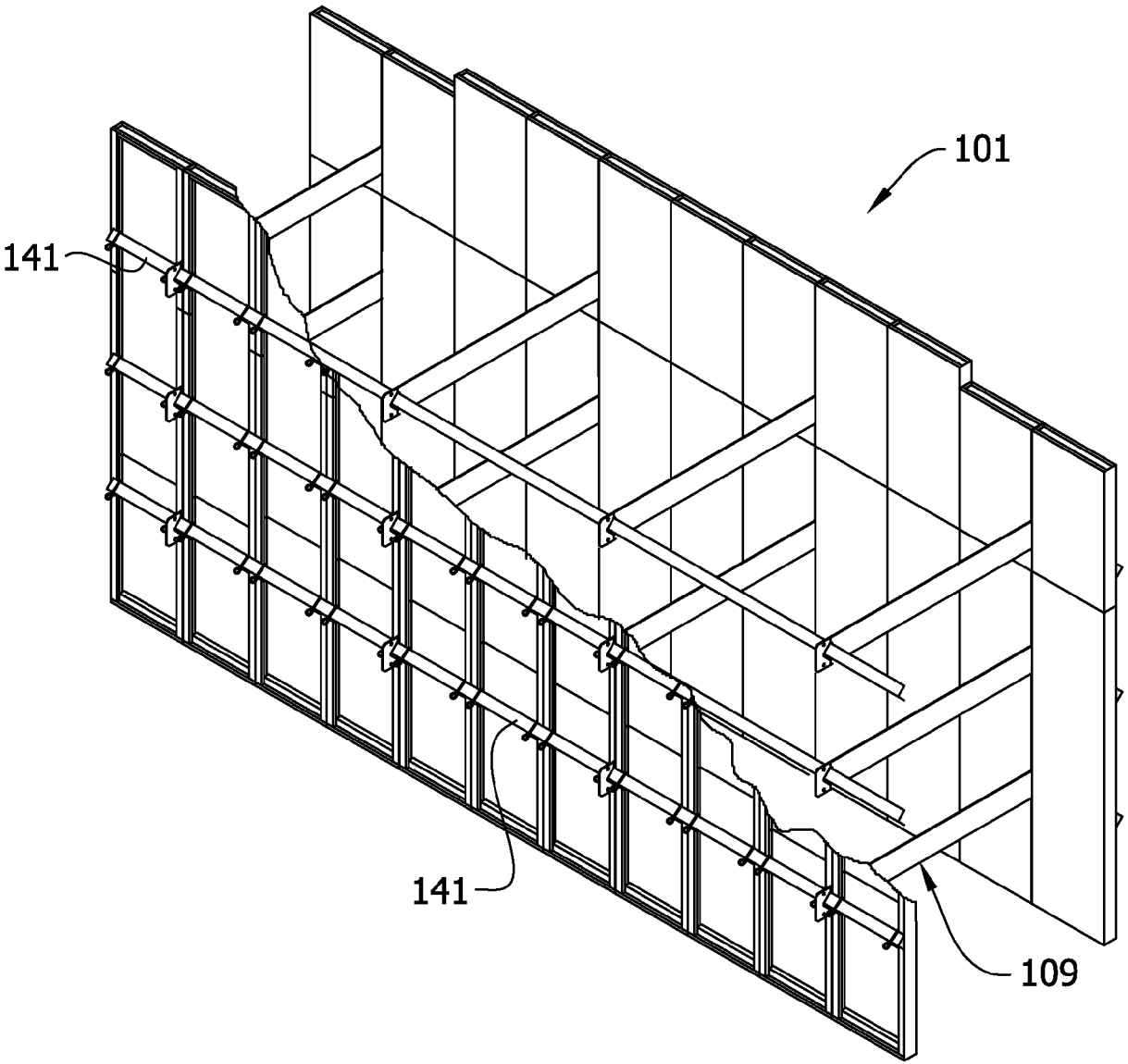
FIG. 2A PRIOR ART
FIGS. 2A-2C show a second version of a prior art mine seal.
Figure 2B:
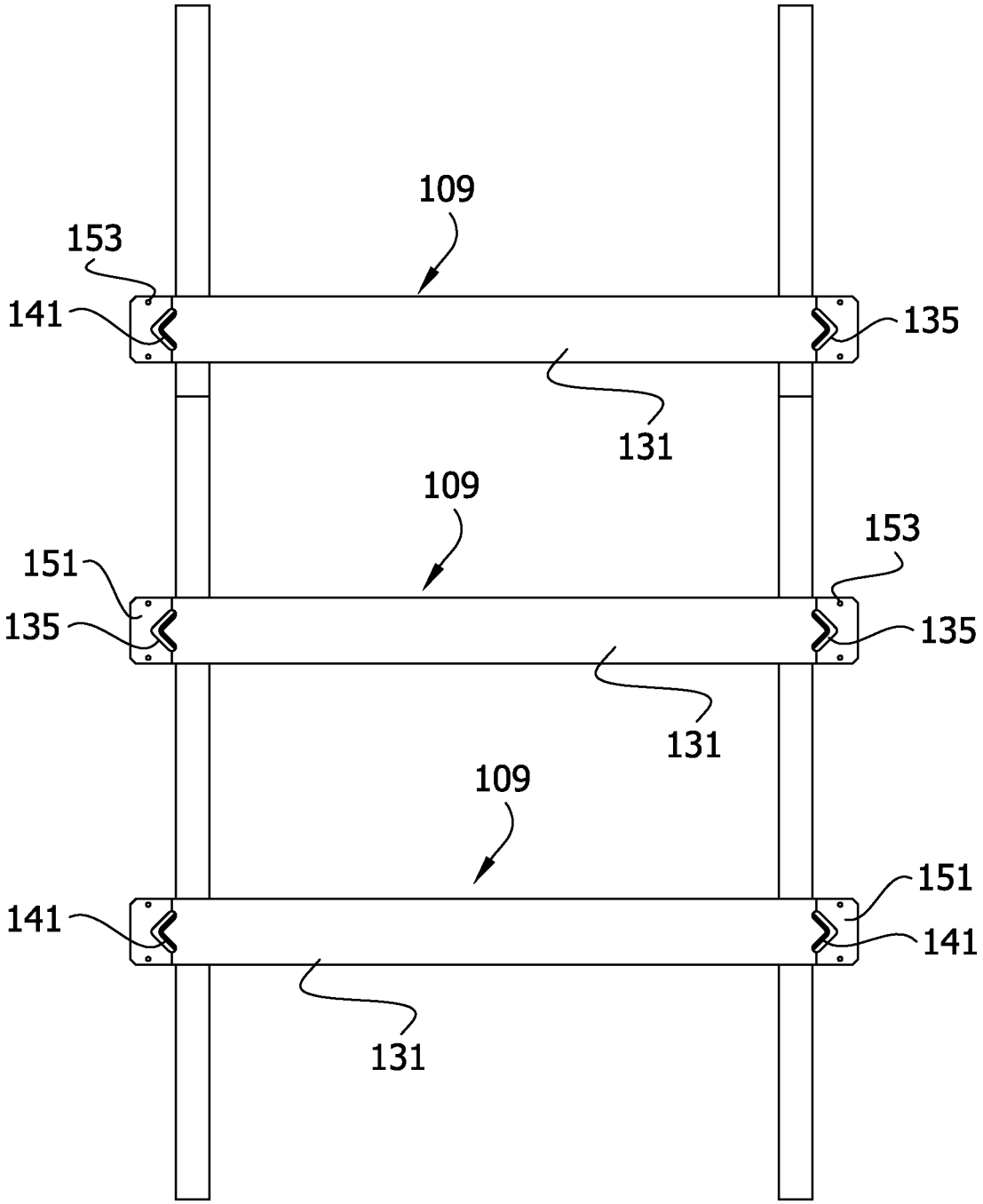
FIG. 2B PRIOR ART
Figure 2C:
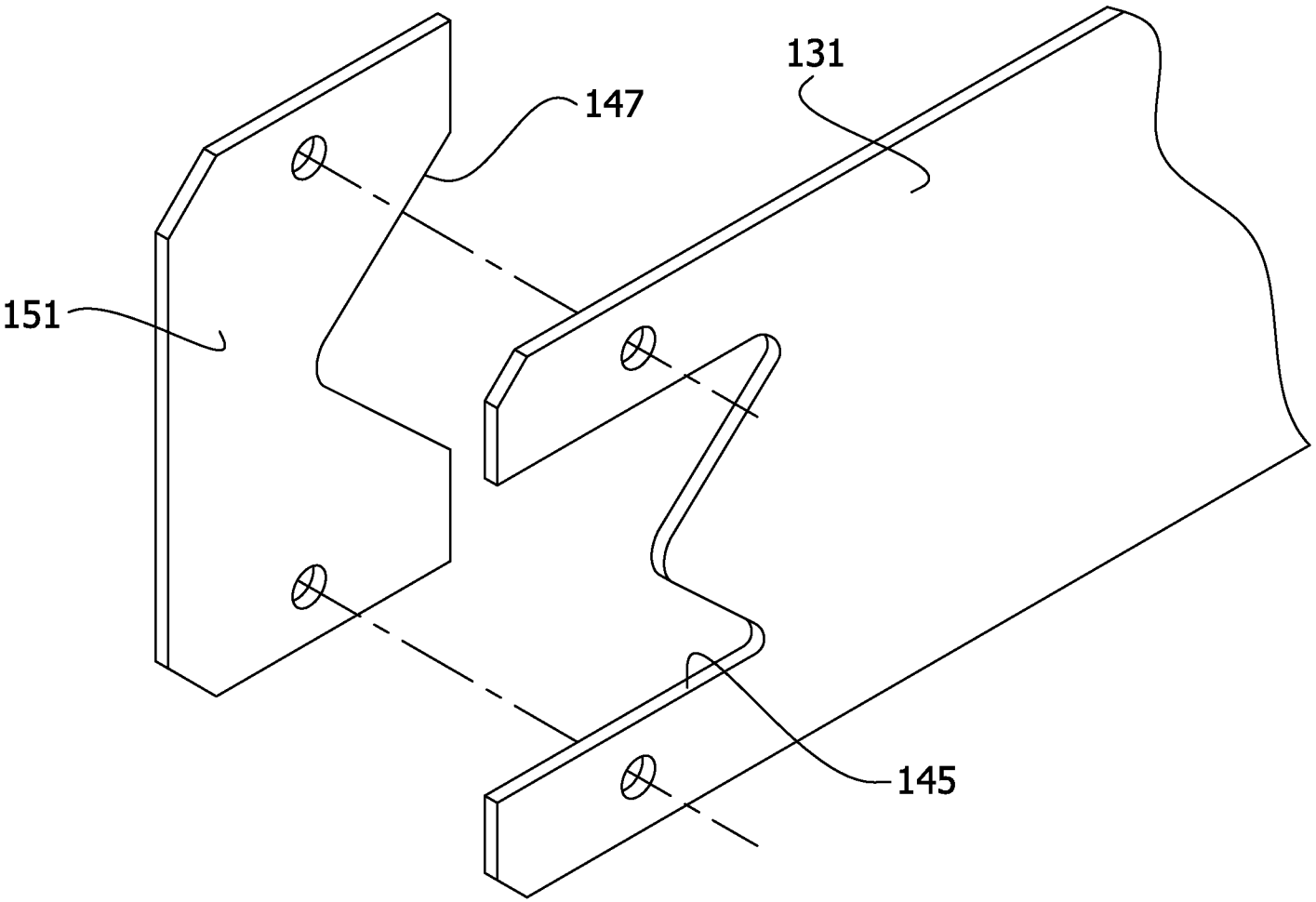
FIG. 2C PRIOR ART
Figure 3A:
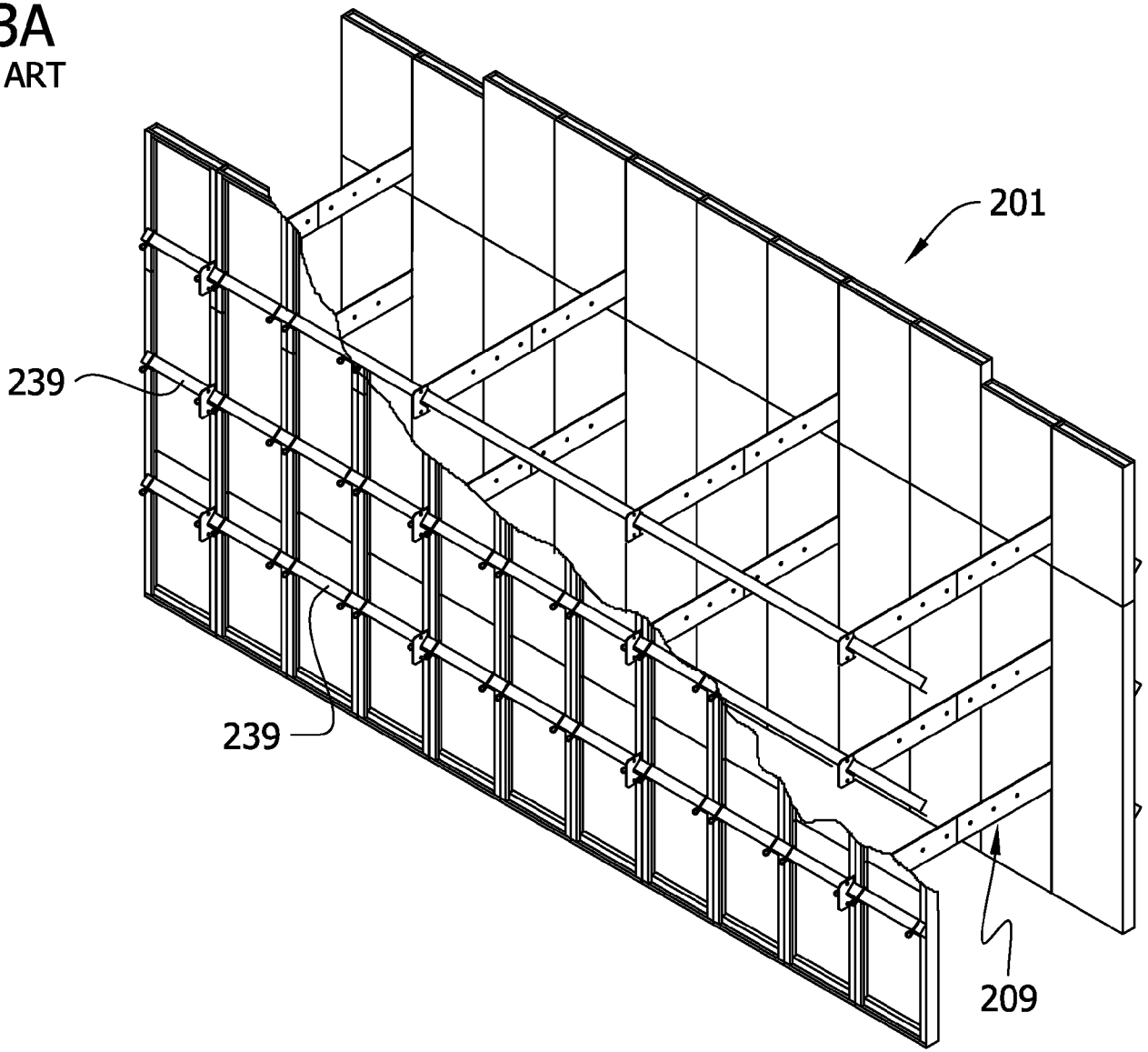
FIG. 3A PRIOR ART
FIGS. 3A-3C show a third version of a prior art mine seal.
Figure 3B:
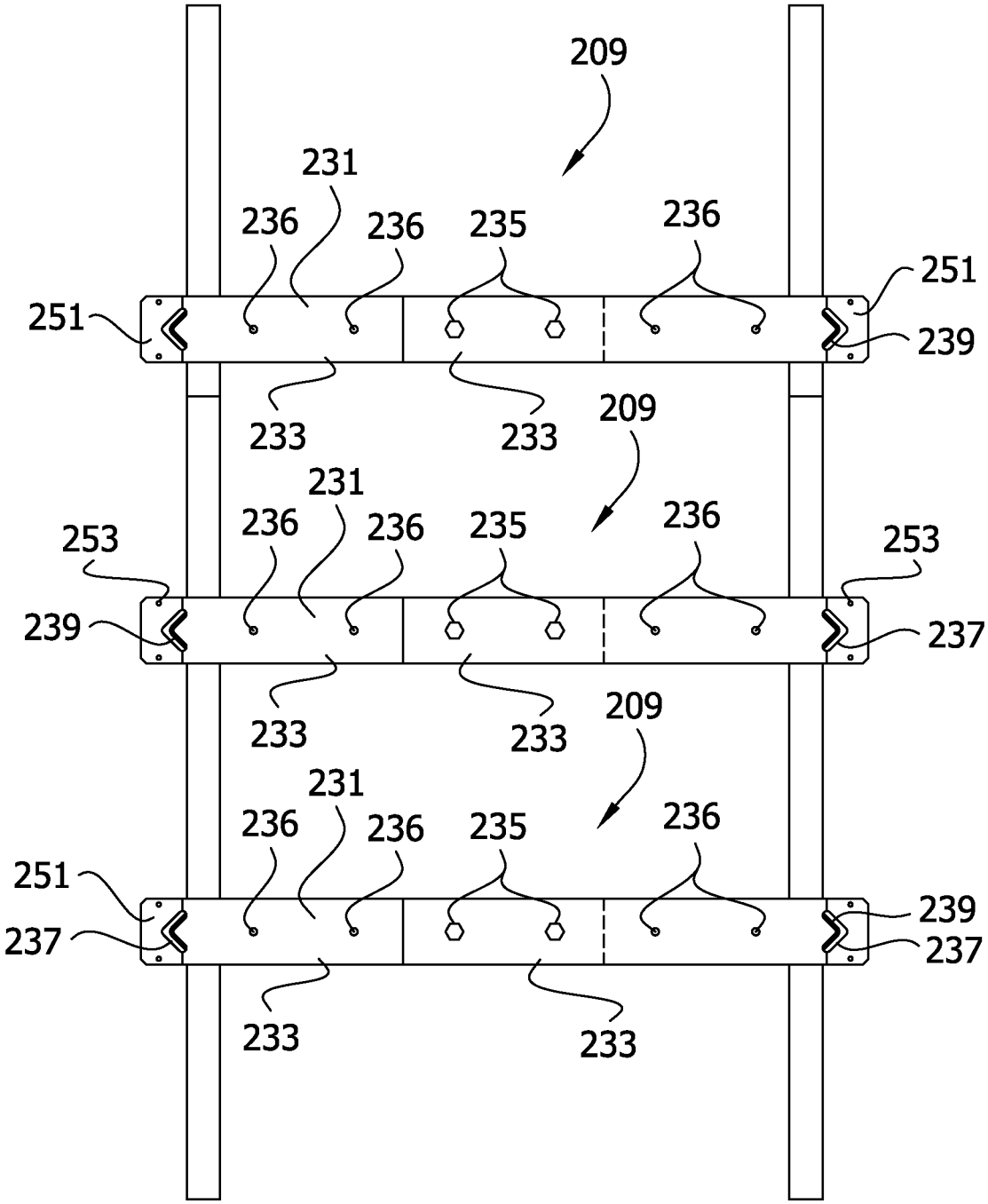
FIG. 3B PRIOR ART
Figure 3C:
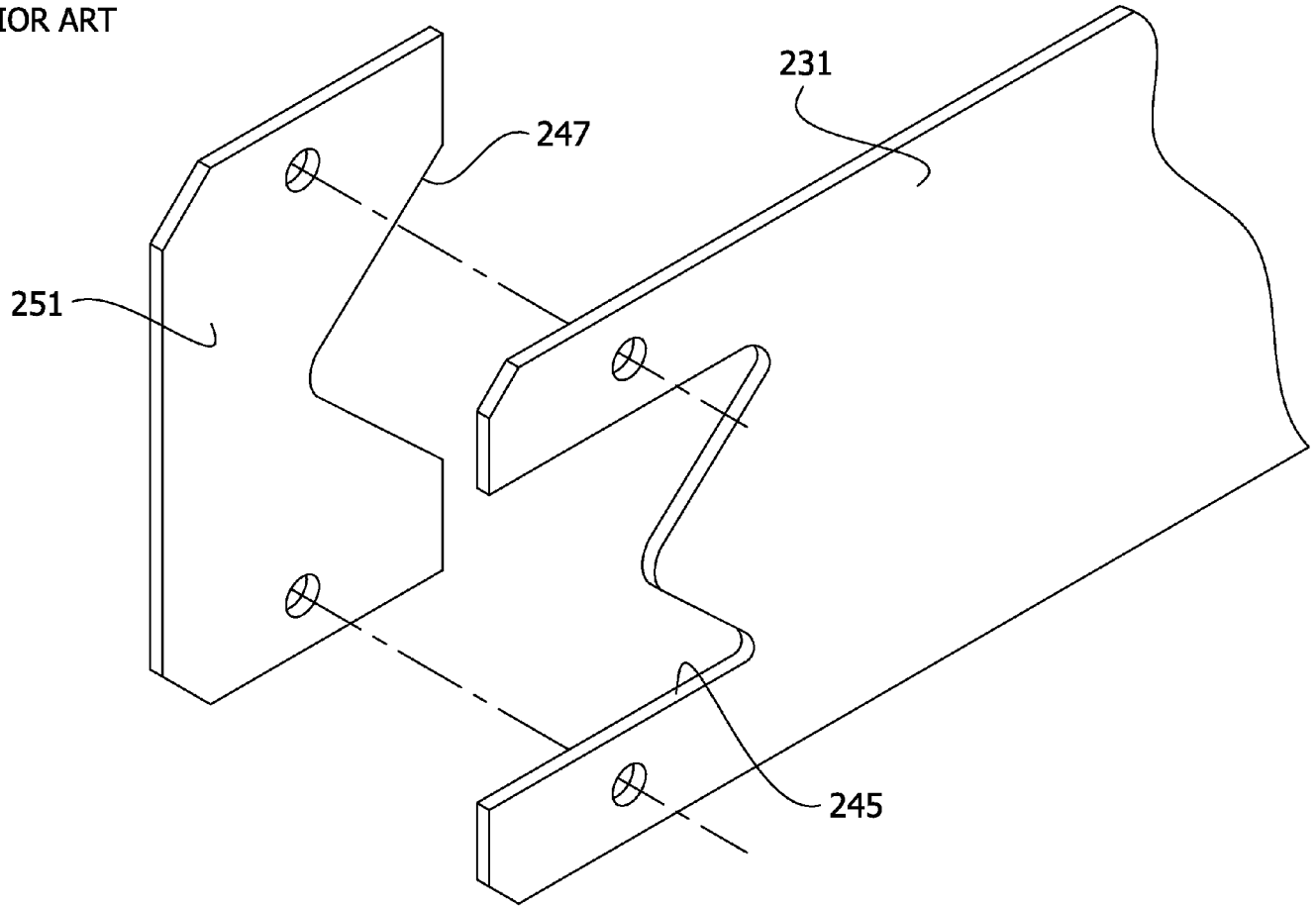
FIG. 3C PRIOR ART
Figure 4A:
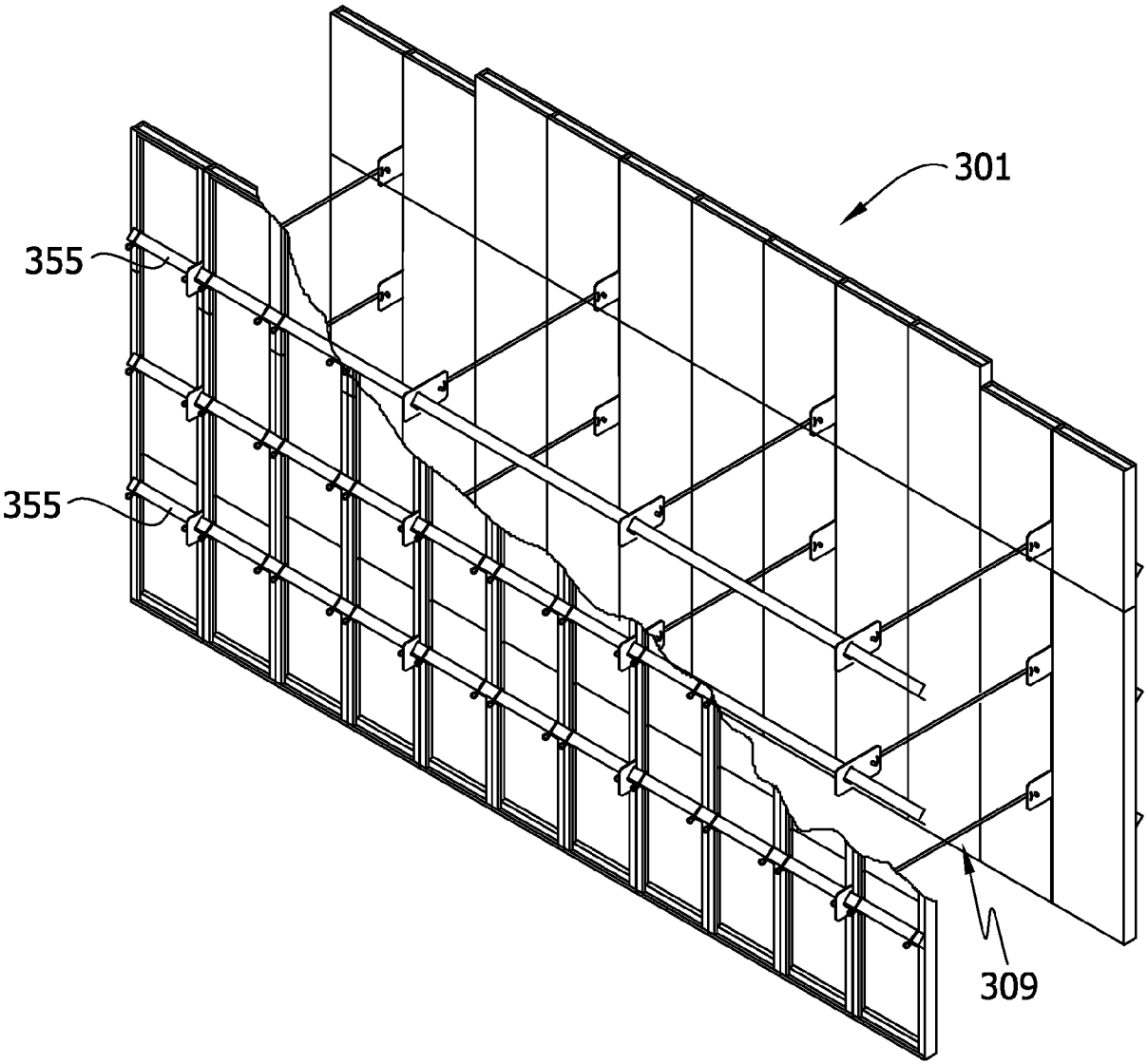
FIG. 4A PRIOR ART
FIGS. 4A and 4B show a fourth version of a prior art mine seal.
Figure 4B:
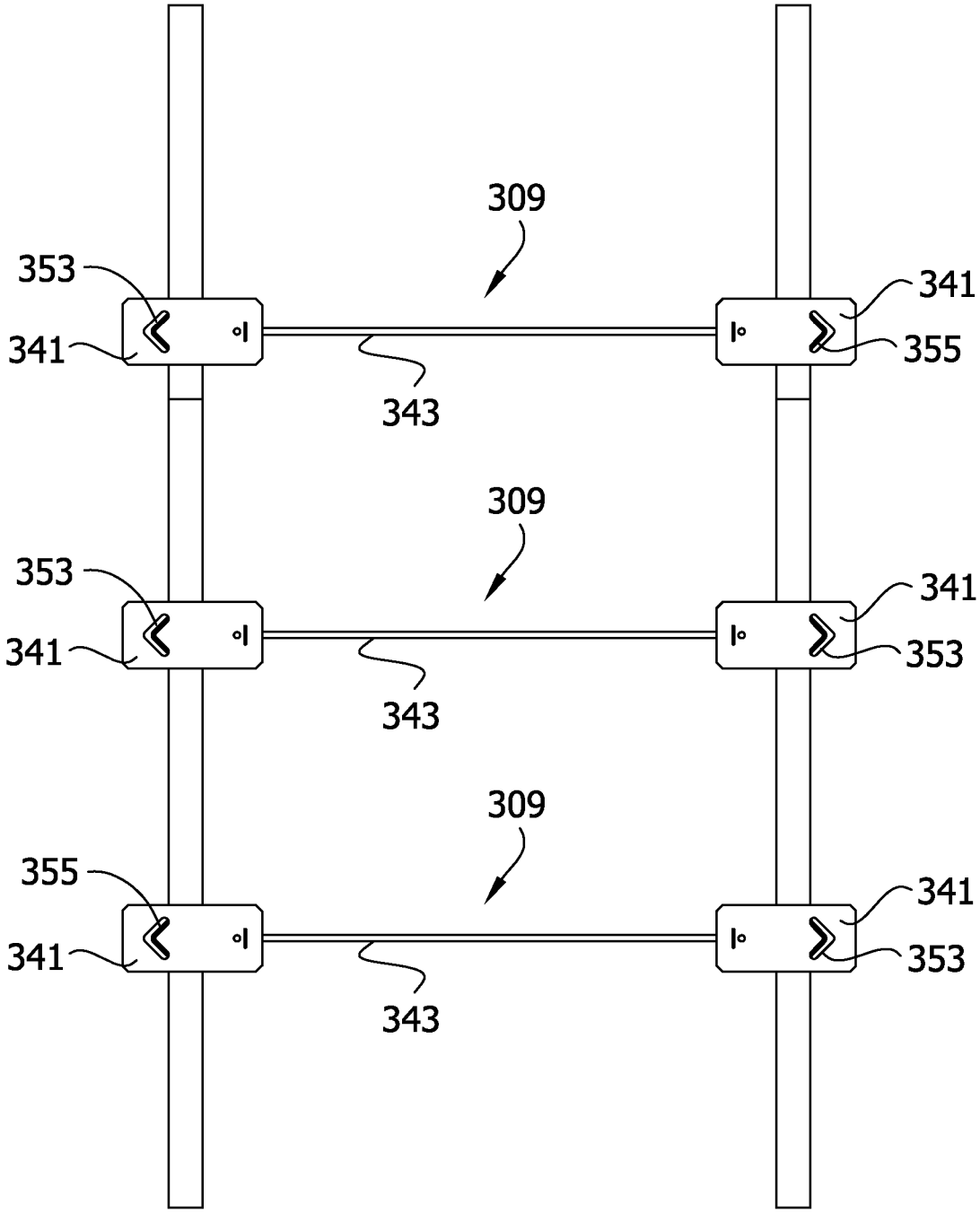
FIG. 4B PRIOR ART
Figure 5A:
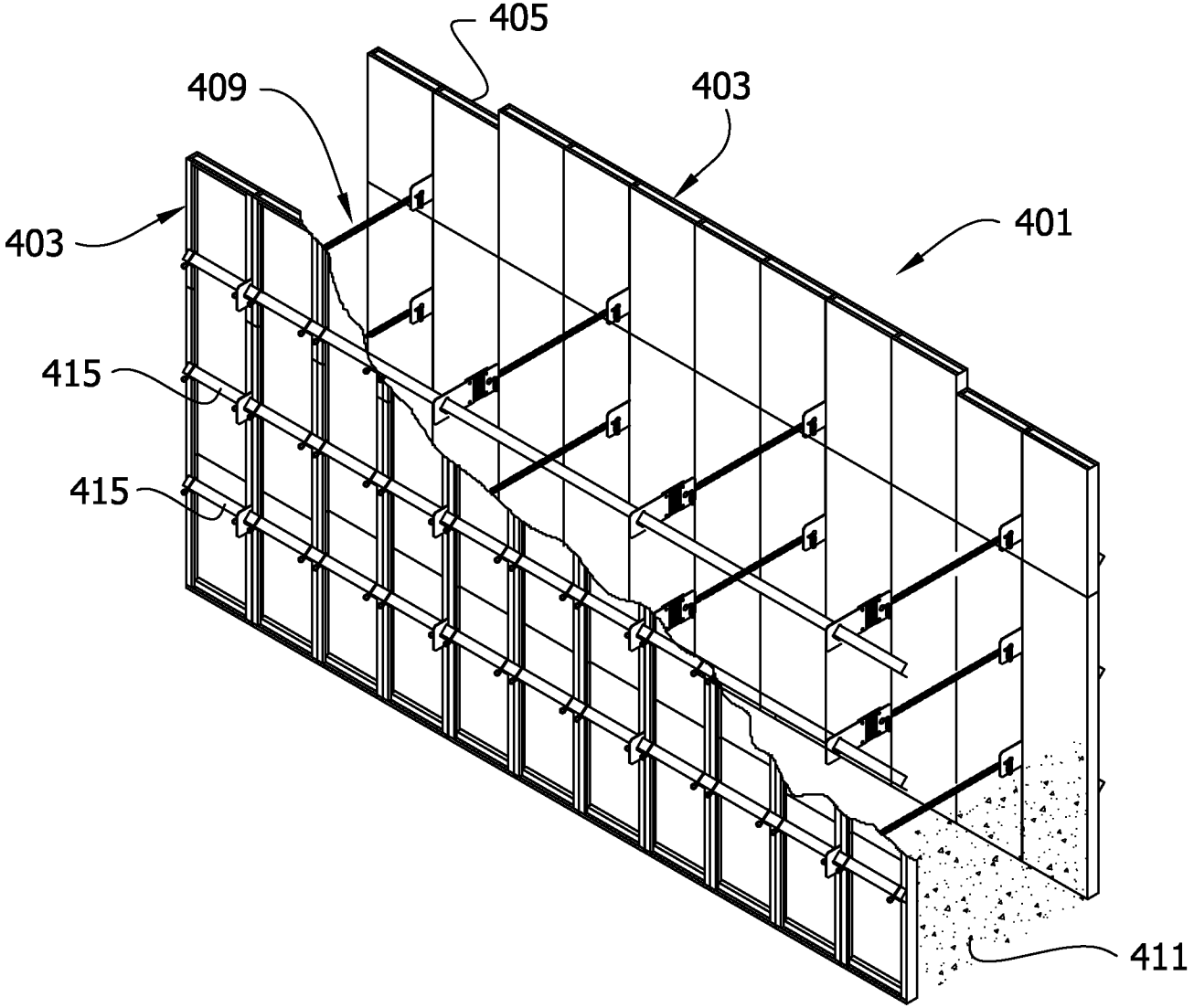
FIGS. 5A-5C show a first embodiment of a mine seal of this invention.
Figure 5B:
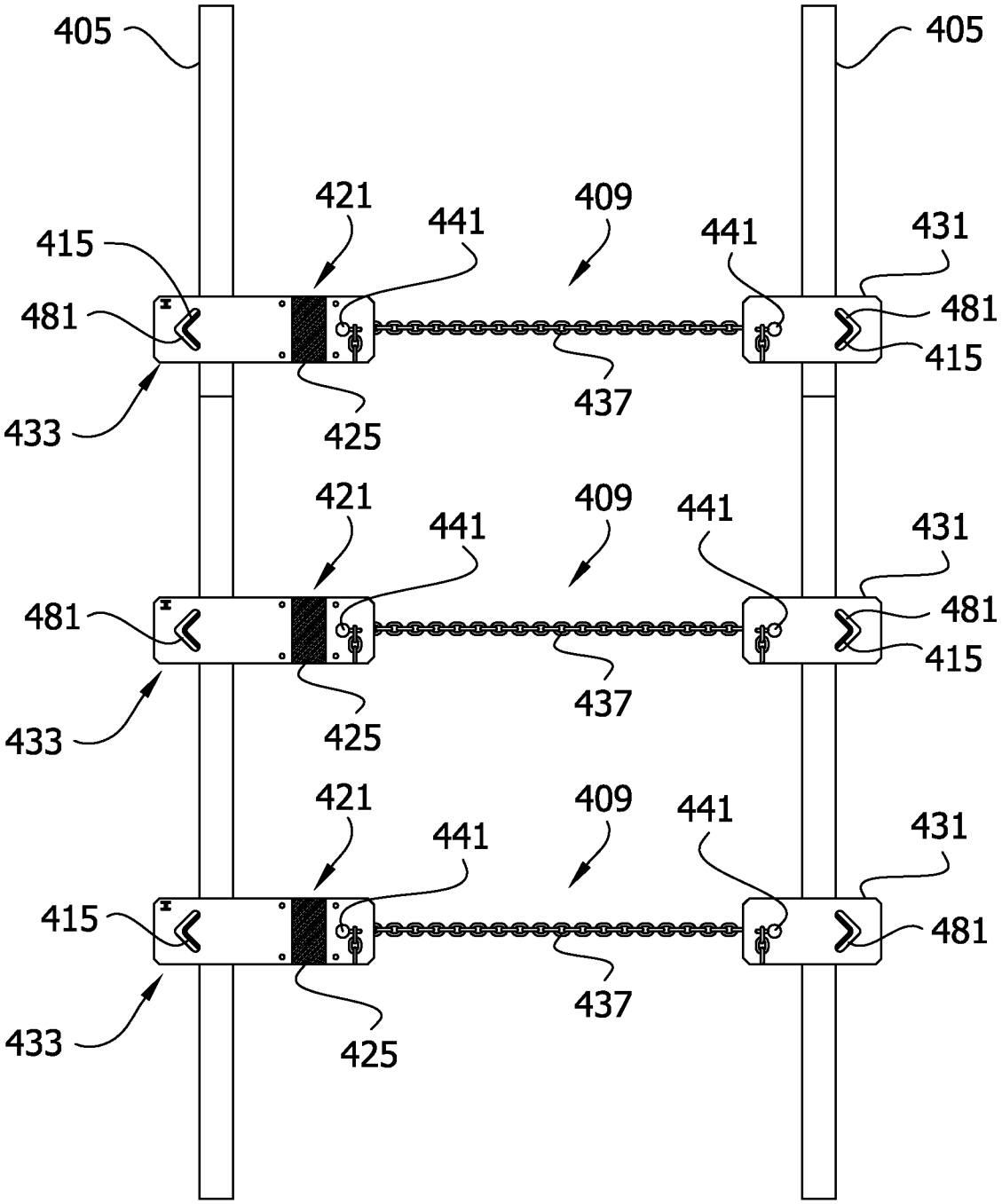
Figure 5C:
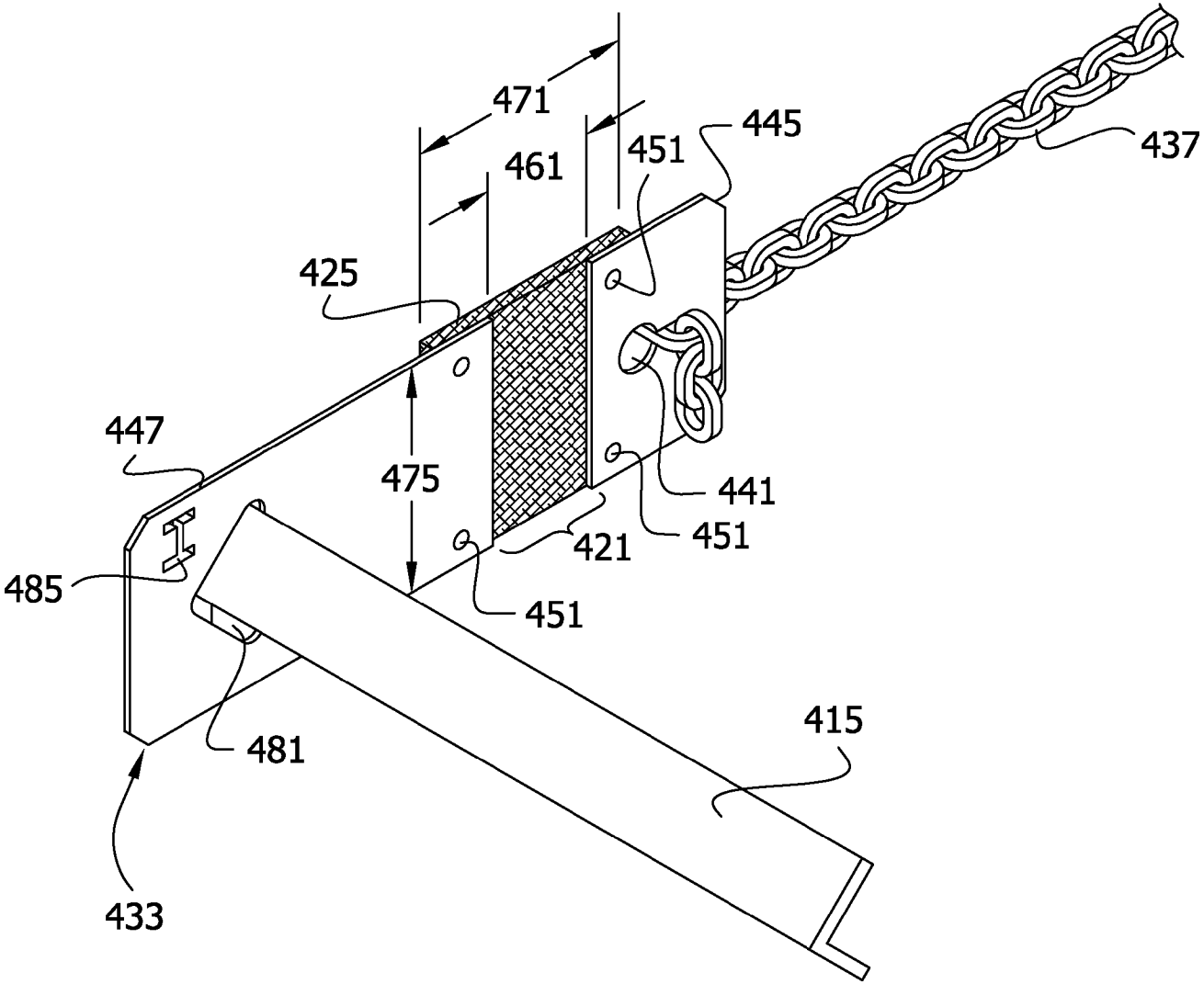

FIGS. 5A-5C show a first embodiment of an electrically non-conductive mine seal of the present invention, generally designated 401. The seal comprises two spaced apart walls 403 made of extensible and contractible panels 405, at least one but typically a plurality of electrically non-conductive ties 409 extending between the walls 403 to hold them in place against forces tending to separate the walls, and a filler material 411 filling the space between the walls. The walls panels 405 are connected by wall supports 415 comprising, in this embodiment, a plurality of horizontal bars (e.g., angle bars) extending on the outside of the walls. These components are described in more detail below.

As noted, the walls 403 are desirably made of extensible and contractible metal panels 405, such as those described in U.S. Pat. No. 5,167,474 and as further described in U.S. Pat. No. 4,483,642, both of which are incorporated by reference herein for purposes not inconsistent with this disclosure. As therein described, the panels 405 are adapted to yield during a mine convergence so that the seal retains its structural integrity and maintains a good pressure fit against the mine walls to prevent leakage past the seal. It will be understood that the walls 403 can be made of other structural wall elements.

The filler material 411 can be full-weight concrete, foamed concrete, or other suitable material, such as described in U.S. Pat. No. 5,167,474.

Each electrically non-conductive tie 409 is a metal tie having at least one insulating gap 421 along its length spanned by an electrically non-conductive member 425 to prevent (or at least substantially prevent) the conduction of electrical current through the mine seal along the tie. In this particular embodiment, the tie 409 comprises a pair of end plates 431, 433 connected by a metal link chain 437 passing through keyhole openings 441 in the end plates. The chain 437 is secured in each opening 141 by passing a link of the chain into the reduced-diameter portion of the keyhole opening 441. One end plate 431 is a metal plate of one-piece construction. The other end plate 433 comprises a pair of metal sections 445, 447 spaced apart to provide the insulating gap 421. Thus, the gap 421 extends across an entire width of the end plate 433 of the tie. The gap is spanned by the non-conductive member 425 which is secured to the metal sections by suitable means 451, e.g., mechanical fasteners such as rivets or nut-and-bolt fasteners, or other metal or non-metal attachment mechanisms.

Referring to FIG. 5C, the insulating gap 421 has a dimension 461 along the length of the tie 409 which will vary, e.g., according to the type of filler material 411 used. If full-weight concrete is used as the filler material 411, the minimum dimension 461 is determined by the likelihood of a single or perhaps few pieces of concrete aggregate that could bridge the gap in an electrical conductive fashion that is atypical of concrete in general. Foamed cement does not include either fine or coarse aggregate, but there may some risk that a piece of foreign material could find its way across the gap in the completed structure. Taking these factors into consideration, the gap 421 has a minimum dimension 461 of at least about 0.5 in., and in this embodiment the dimension 461 is about 2.0 in. Of course, this dimension 461 may be substantially larger, all the way to a situation where the tie is made completely of dielectric material, although costs and thickness must also be considered.

The electrically non-conductive member 425 spanning the gap 421 has a first dimension 471 along the length of the tie greater than the dimension 461 of the gap, so that the member overlaps the metal end plate sections 445, 447 a distance sufficient to provide fastening areas sized for secure attachment of the member 425 to the metal sections. The non-conductive member has a second dimension 475 generally transverse to the dimension 471 (i.e., generally across the width of the tie). Desirably, this dimension 471 is not substantially greater than and, even more desirably about equal to the corresponding dimension (e.g., height) of the metal end plate sections 445, 447 so that the size of the non-conductive member 425 is kept relatively small to avoid lines of cleavage in the seal 401.

The non-conductive member 425 has suitable physical properties, including the strength in tension to hold the walls 403 in place during and after placement of the filler material between the walls of the mine seal, and the tensile, shear and/or tear strength necessary to withstand the forces (e.g., localized stress in the areas of the fasteners) required to attach the member to the metal sections of the end tie plate. Desirably, the non-conductive member 425 is of a material which permits fabrication at reasonable cost, which is resistant to failure in bending or other non-tensile modes during handling, installation and pouring of the filler material between the walls of the seal, resistant to water in storage and as the cement is poured and prior to curing, and resistant to the moisture always present in a mine atmosphere which prevents the seal from becoming fully "dry." The member 425 should also have suitable dielectric properties, including good dielectric strength so that electrical current due to lightning strikes, for example, is not conducted across the seal through the tie.

Many types of non-conductive material meet the above criteria. However, many of these materials, including many commonly used plastics, are not strong enough to make the connection to the metal end plate sections 445, 447 without using many fasteners over a large area and without requiring large cross sectional areas. One material which has been found to be suitable is Micarta® structural insulating board, a phenolic plastic laminate developed by Westinghouse. This material has sufficient tensile strength and toughness to keep the size of the non-conductive member 425 relatively small. By way of example but not limitation, for a metal end tie plate 433 having a height of about four inches, a thickness of about 1/16 in. and a gap dimension 461 of about two inches, a non-conductive member 425 of Micarta® structural insulating board has a dimension 471 of about four inches in. (allowing about a one inch lap on opposite sides of the two-inch gap 421), a dimension 475 of about four inches and a thickness of about ¼ in. The non-conductive member 425 may be made from other non-conductive materials (e.g., fiber-reinforced plastic).

The outer ends of the tie end plates 431, 433 protrude through the walls 403 of the seal (e.g., between adjacent panels 405) and have V-shaped openings 481 for receiving the wall supports 415. The supports 415 and openings 481 may have other shapes.

Each tie 409 has a suitable marking 485 on the tie to indicate that it is an electrically non-conductive tie, thereby differentiating it from the prior art conductive ties. Desirably, this marking 485 is on a portion of the tie which is readily visible when the after the mine seal has been installed, such as the outer end sections (e.g., 447) of the tie protruding outward beyond the walls 403 of the seal 401. Desirably, the marking is of a permanent nature, and in one embodiment comprises a marking stamped into the metal or piercing the metal, such as the letter "I" indicating that the tie is "insulated." Other markings may be used.

Figure 6A:
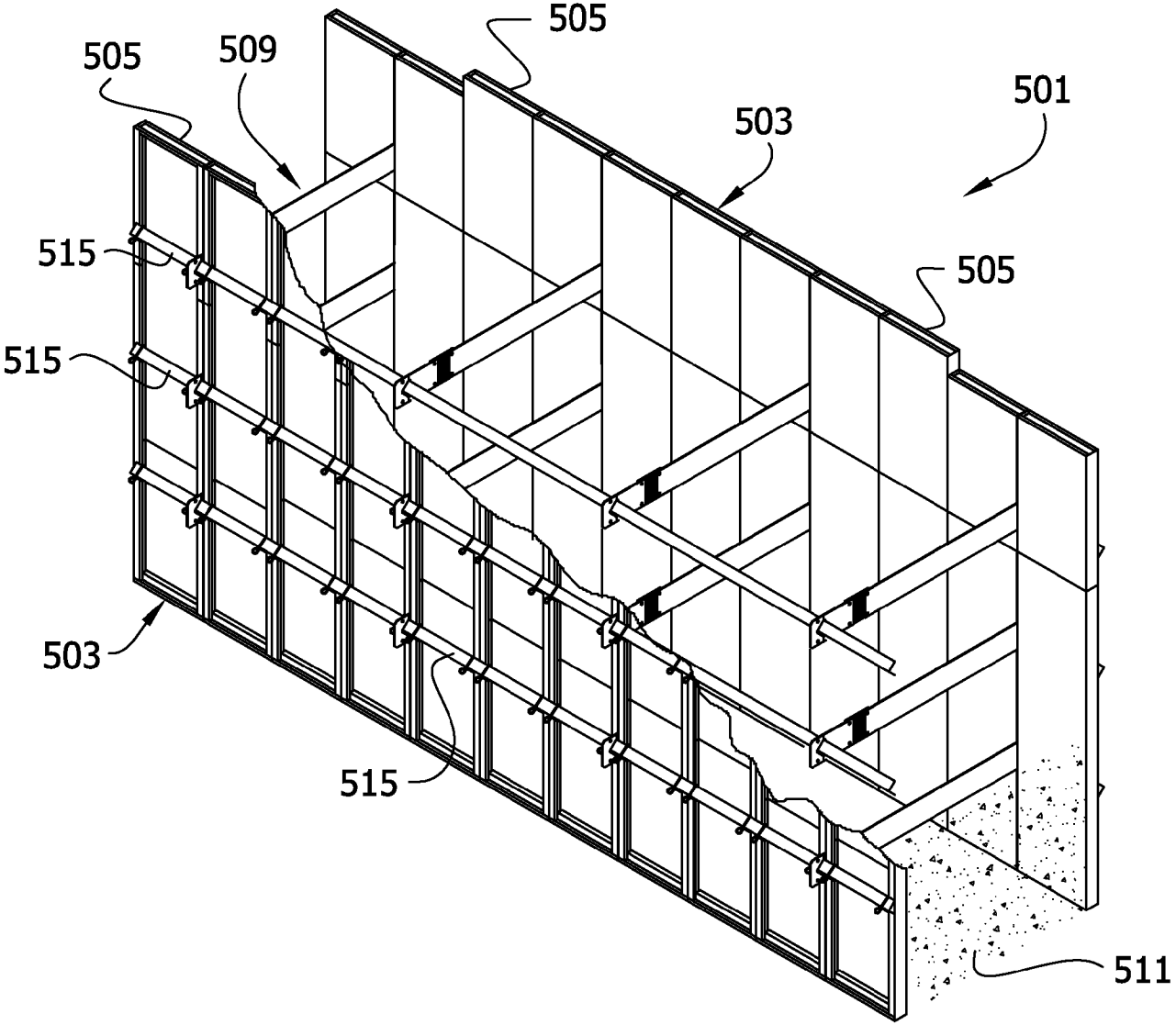
FIGS. 6A-6C show a second embodiment of a mine seal of this invention.
Figure 6B:
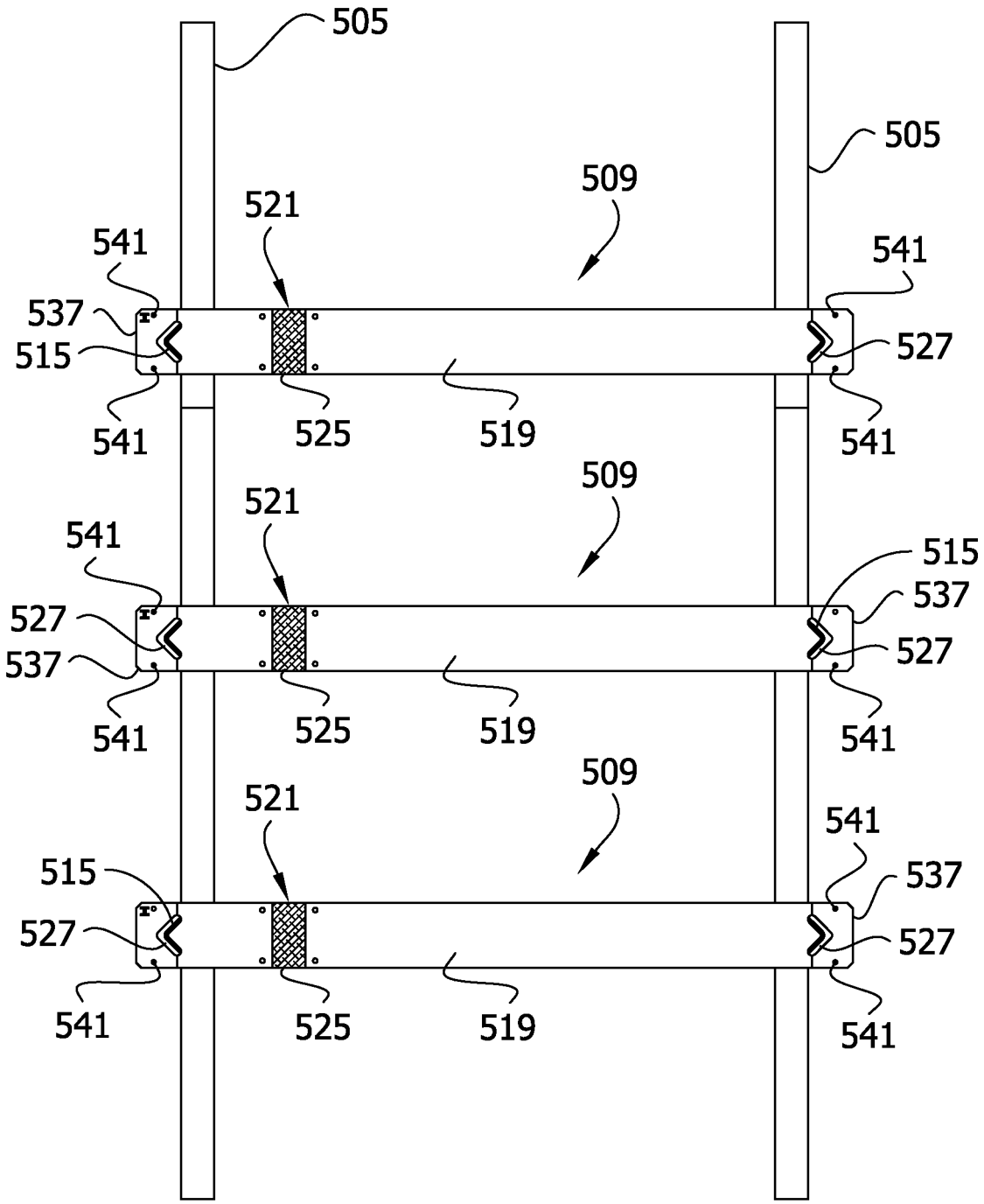
Figure 6C:
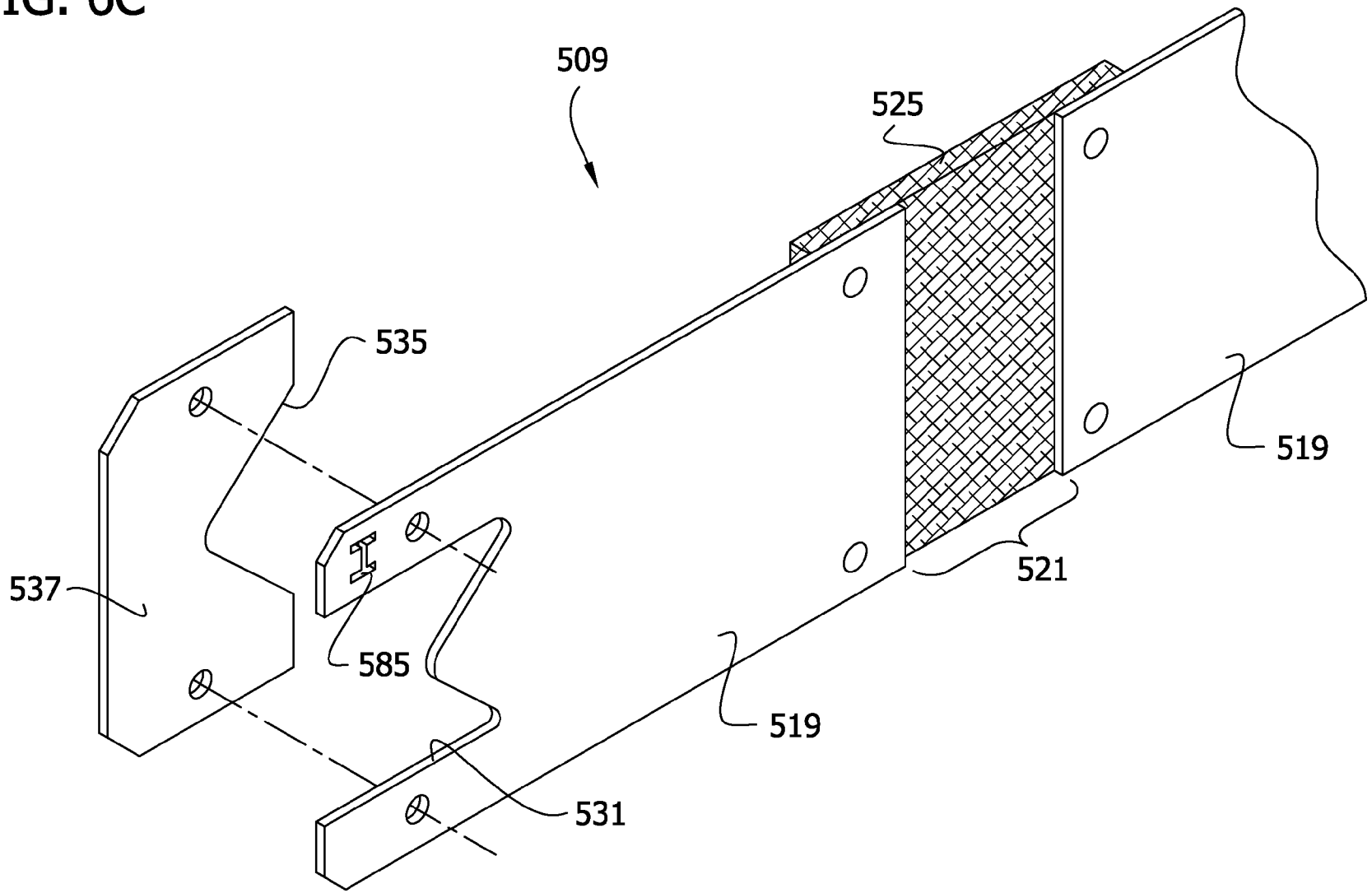

FIGS. 6A-6C illustrate a second embodiment of a mine seal, generally designated 501, made in accordance with this invention. The seal comprises two spaced apart walls 503 each made of extensible and contractible panels 505, electrically non-conductive ties 509 extending between the walls 503 and holding them in place against forces tending to separate the walls, and a filler material 511 filling the space between the walls. The walls panels 505 are connected by wall supports 515 comprising, in this embodiment, a plurality of horizontal bars (e.g., angle bars) extending on the outside of the walls 503.

The filler material 511 can be full-weight concrete, foamed concrete, or other suitable material, such as described in U.S. Pat. No. 5,167,474.

In this embodiment, each tie 509 comprises an elongate metal plate or bar 519 having at least one insulating gap 521 along its length spanned by a non-conductive member 525 to prevent the conduction of electrical current through the mine seal along the tie. The physical and electrical characteristics of the gap 521 and non-conductive member 525 are essentially identical to those of the gap 421 and non-conductive member 425 of the previous embodiment. The means for attaching the non-conductive member 525 to the metal plate 519 is also the same as the means 451 of the first embodiment.

Each tie 509 has two openings 527 adjacent opposite ends of the bar 519 for receiving the wall supports 515. As best illustrated in FIG. 6C, each opening 527 is formed by the combination of a notch 531 in a respective end of the metal bar 519 and a mating notch 535 in an end section or piece 537 secured by suitable fasteners 541 (e.g., rivets) to the bar 519. The openings 527 can be formed in other ways and have other shapes.

As in the previous embodiment, each tie 509 desirably has a suitable marking 585 on the tie to indicate that it is an electrically non-conductive tie, thus differentiating it from the prior art conductive ties.

Figure 7A:
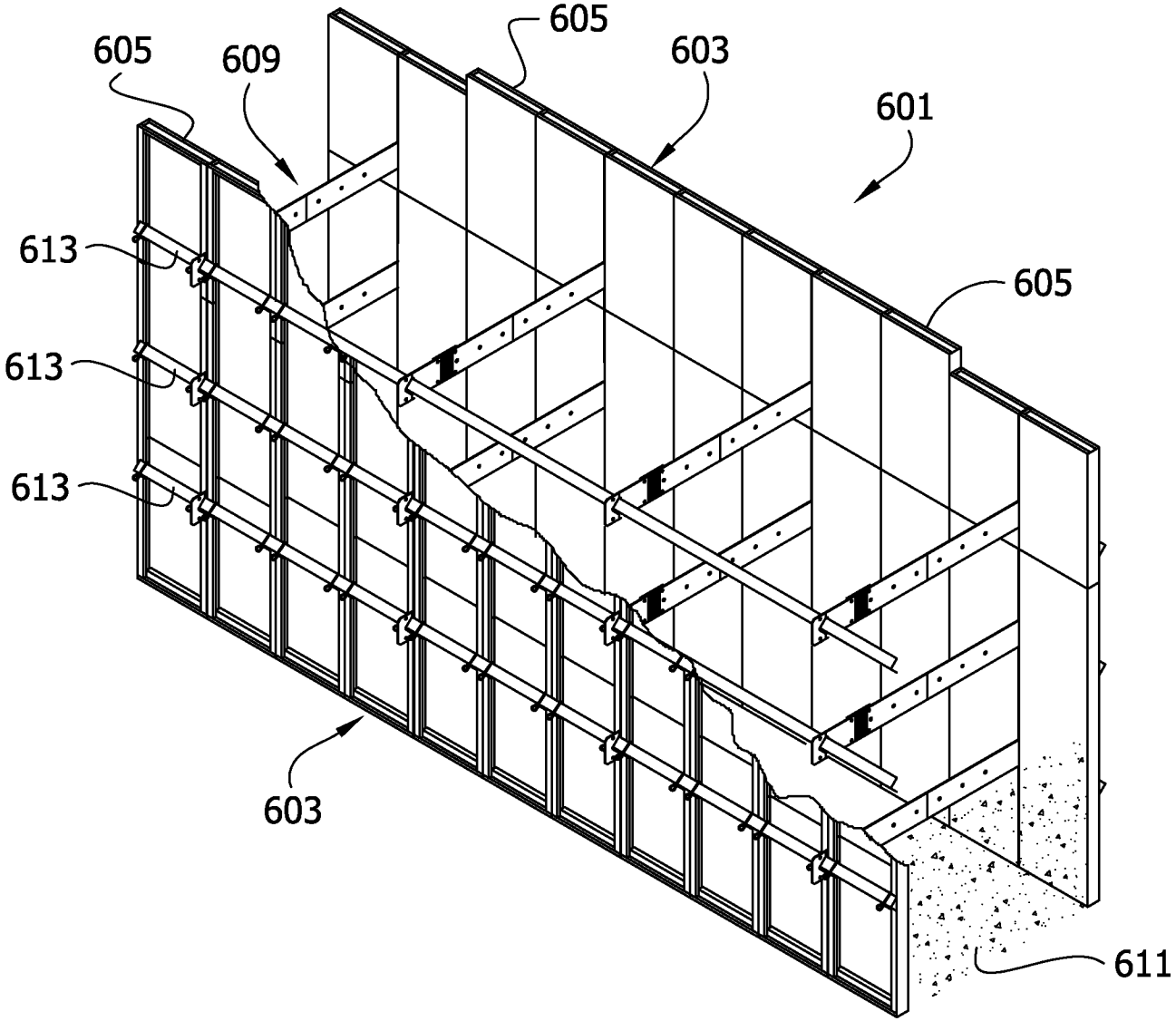
FIGS. 7A-7C show a third embodiment of a mine seal of this invention.
Figure 7B:
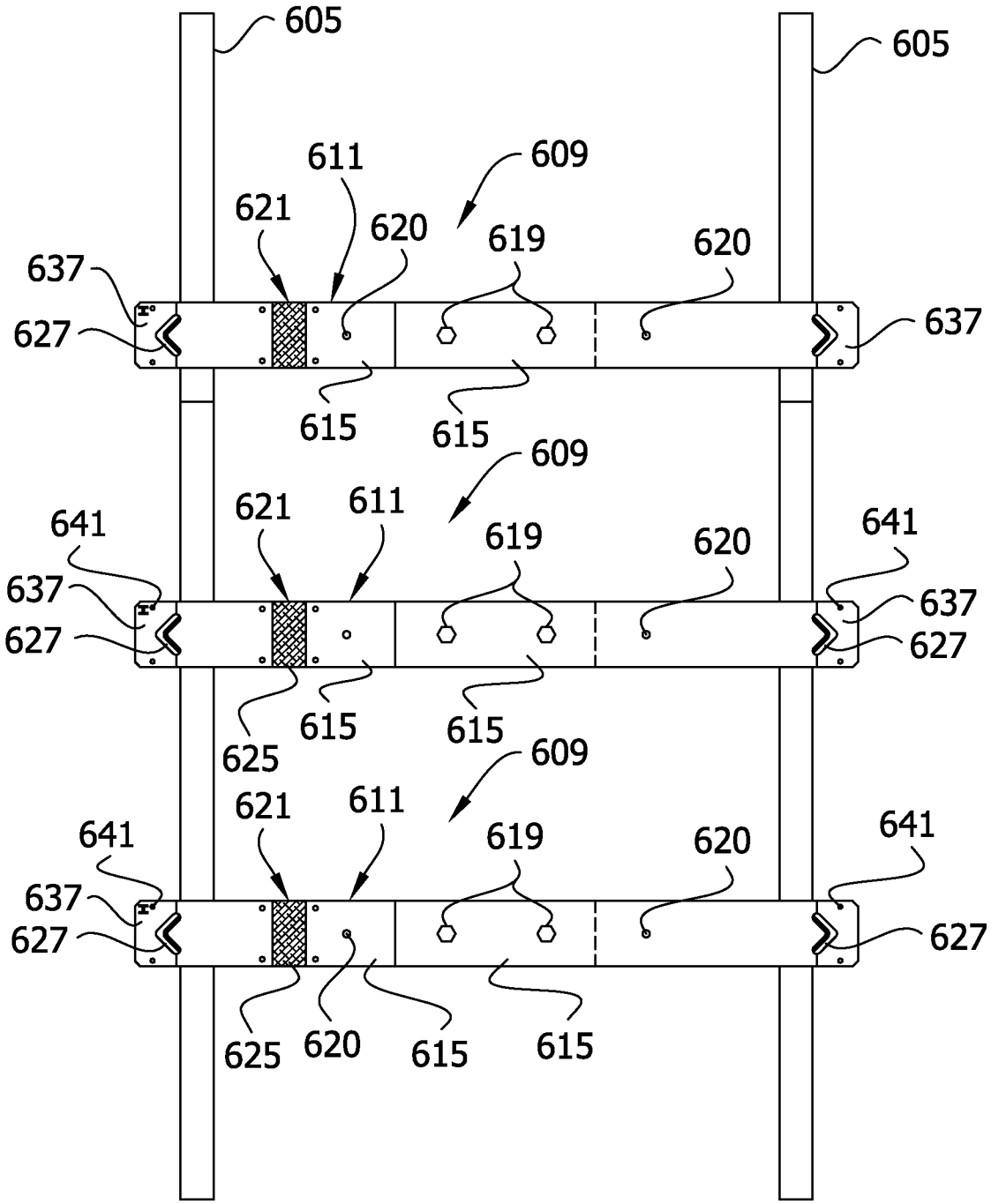
Figure 7C:
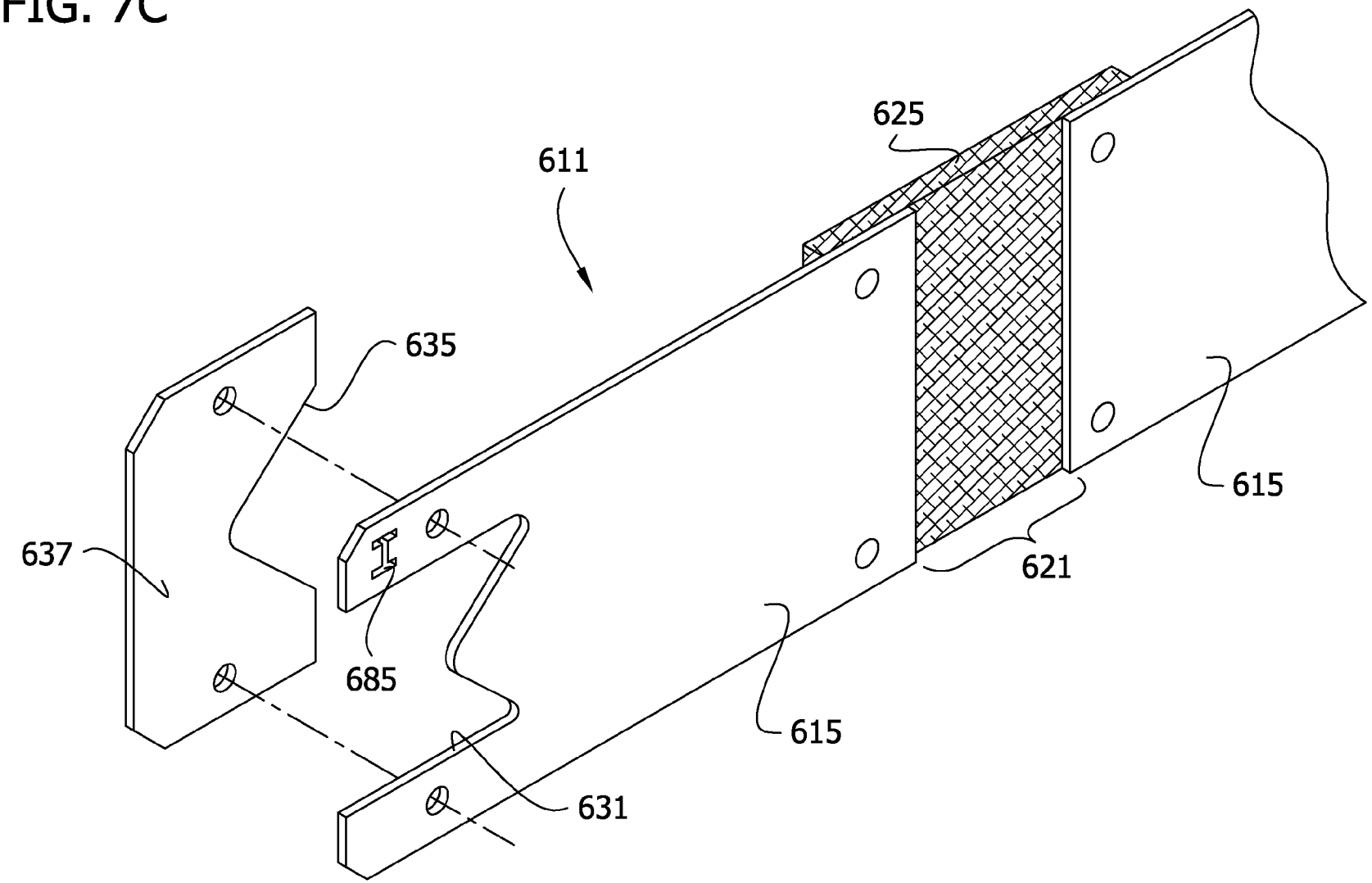

FIGS. 7A-7C illustrate a third embodiment of a mine seal, generally designated 601, made in accordance with this invention. The seal comprises two spaced apart walls 603 each made of extensible and contractible panels 605, non-conductive ties 609 extending between the walls 603 and holding them in place against forces tending to separate the walls, and a filler material 611 filling the space between the walls. The walls panels 605 are connected by wall supports 613 comprising, in this embodiment, a plurality of horizontal bars (e.g., angle bars) extending on the outside of the walls 603.

The filler material 611 can be full-weight concrete, foamed concrete, or other suitable material, such as described in U.S. Pat. No. 5,167,474.

In this embodiment, each tie 609 comprises an adjustable-length elongate metal plate or bar 611 comprising a plurality of overlapping sections 615 secured together by suitable fasteners 619 (e.g., nut-and-bolt fasteners) extending through selected aligned holes 620 in the overlapping sections 615. The tie 609 has at least one insulating gap 621 along its length spanned by a non-conductive member 625 to prevent the conduction of electrical current through the mine seal along the tie. The physical and electrical characteristics of the gap 621 and non-conductive member 625 are essentially identical to those of the gap 421 and non-conductive member 425 of the first embodiment. The means for attaching the non-conductive member 625 to the metal tie 609 is also the same as the means 451 of the first embodiment.

Each tie 609 has two openings 627 adjacent opposite ends of the bar 611 for receiving the wall supports 613. Each opening 625 is formed by the combination of a notch 631 in a respective end of the metal bar 611 and a mating notch 635 in an end piece 637 secured by suitable fasteners 641 (e.g., nut-and-bolt fasteners or rivets) to the bar 611. The openings 625 can be formed in other ways and have other shapes.

As in the previous two embodiments, each tie 609 desirably has a suitable marking 685 on the tie to indicate that it is a non-conducting tie, thereby differentiating it from the prior art conductive ties.

Figure 8A:
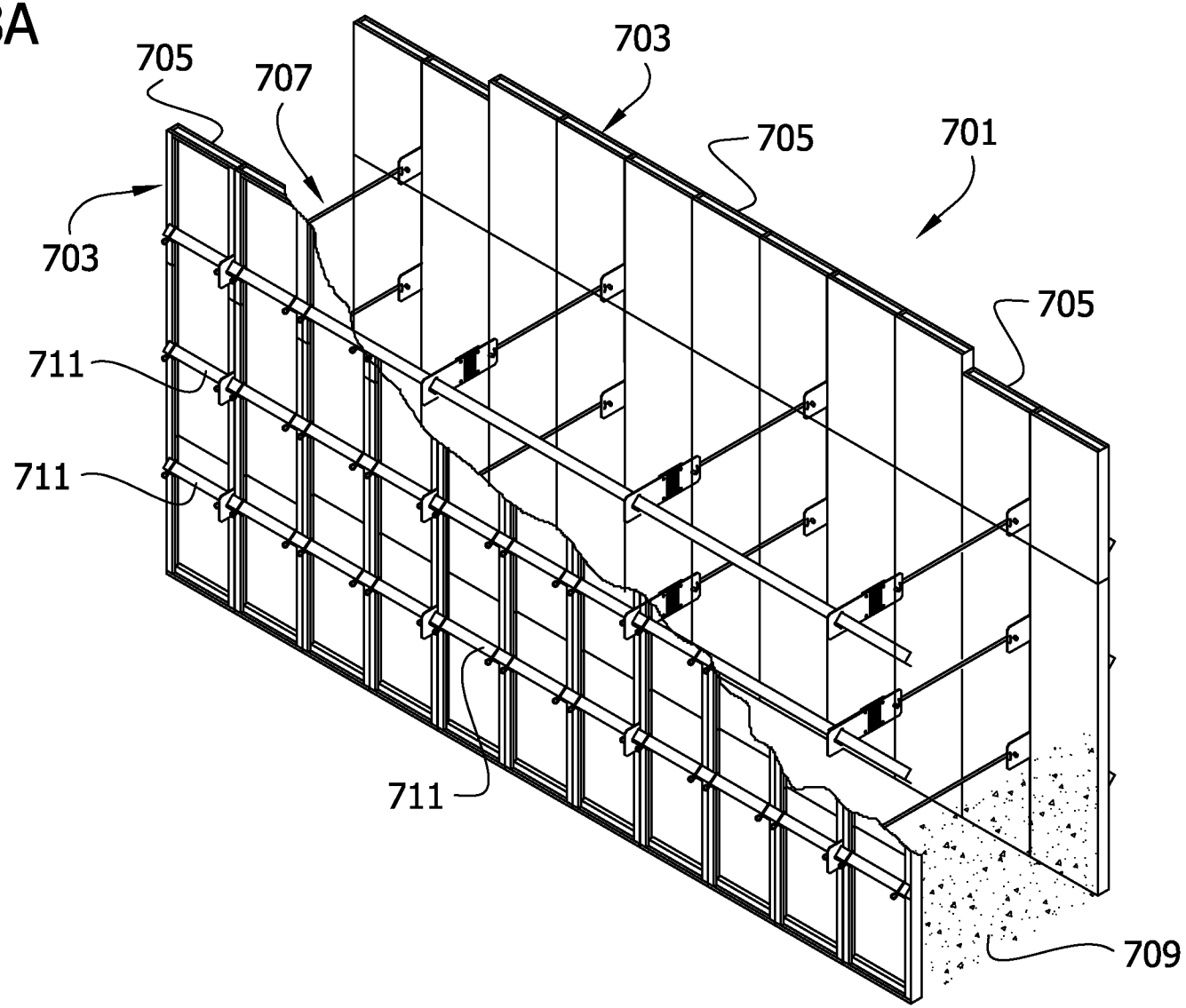
FIGS. 8A-8C show a fourth embodiment of a mine seal of this invention.
Figure 8B:
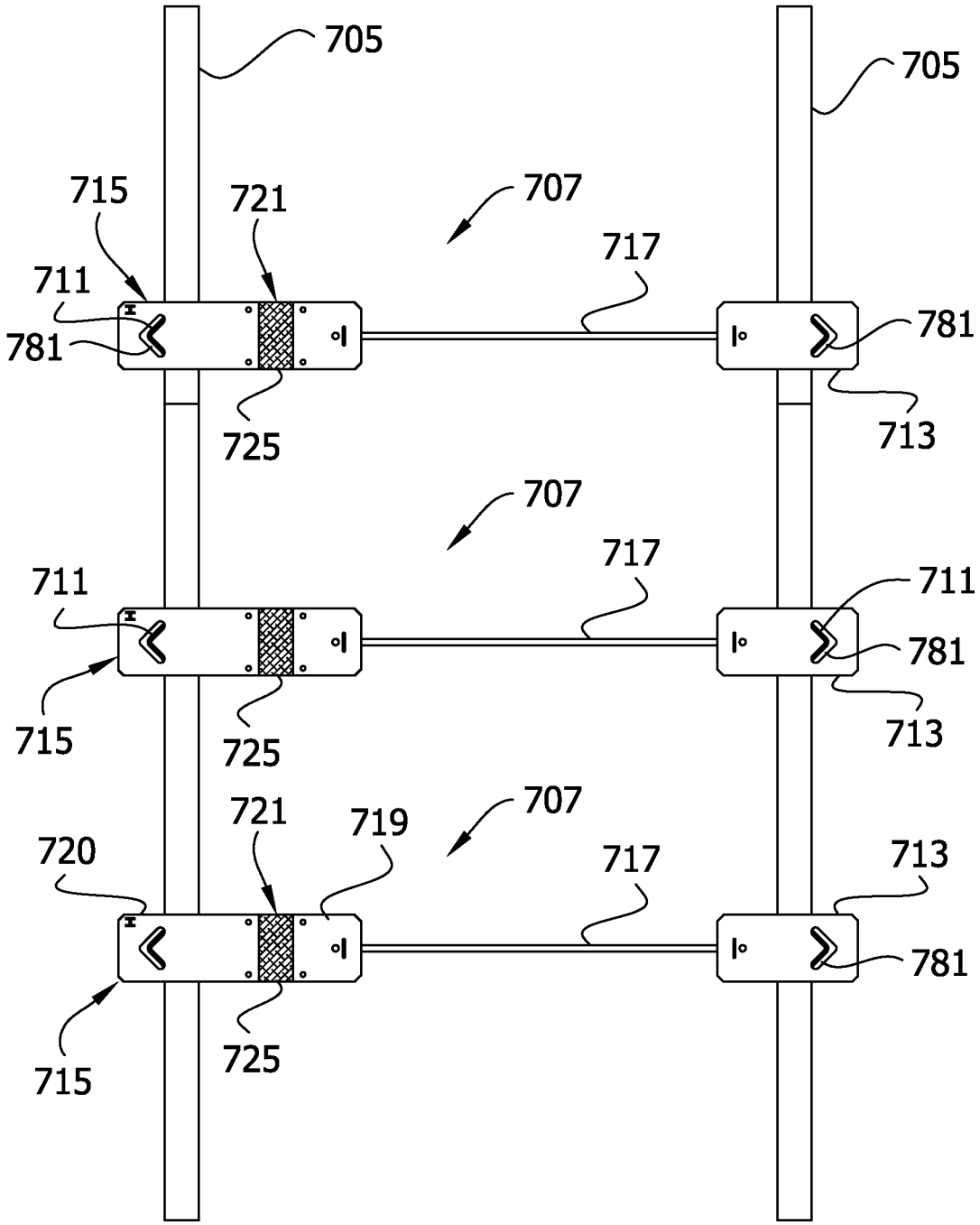
Figure 8C:
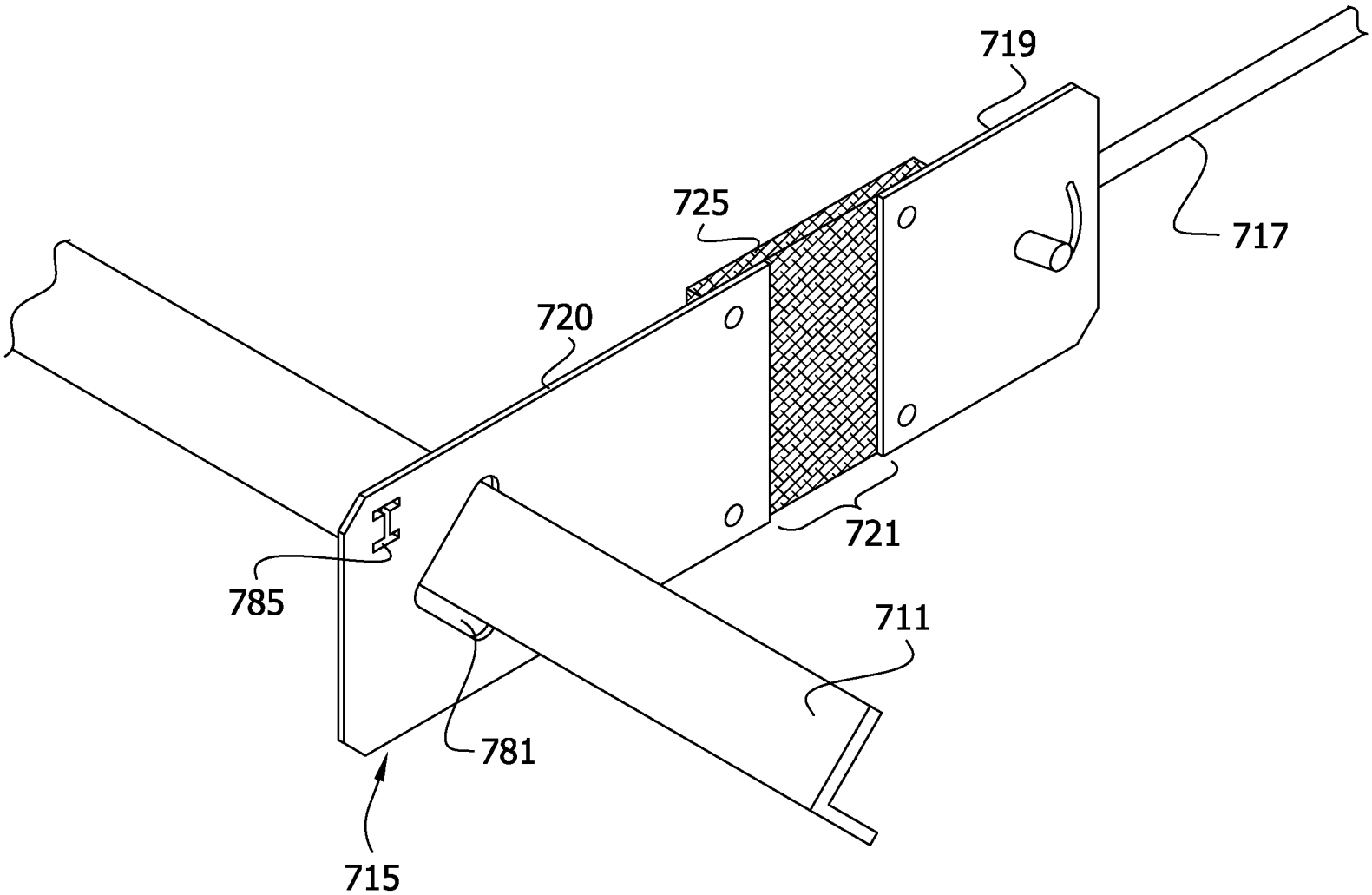

FIGS. 8A-8C illustrate a fourth embodiment of a mine seal, generally designated 701, made in accordance with this invention. The seal comprises two spaced apart walls 703 each made of extensible and contractible panels 705, non-conductive ties 707 extending between the walls 703 and holding them in place against forces tending to separate the walls, and a filler material 709 filling the space between the walls. The walls panels 705 are connected by wall supports 711 comprising, in this embodiment, a plurality of horizontal bars (e.g., angle bars) extending on the outside of the walls.

The filler material 709 can be full-weight concrete, foamed concrete, or other suitable material, such as described in U.S. Pat. No. 5,167,474.

In this embodiment, each tie 707 comprises a pair of end tie plates 713, 715 connected by a metal rod 717 secured to the end tie plates. One of the end plates 713 is of one-piece construction. The other end plate 715 comprises a pair of metal sections 719, 720 spaced apart to provide an insulating gap 721 (FIG. 8C). The gap is spanned by a non-conductive member 725 which is secured to the metal sections by suitable means 731, e.g., mechanical fasteners such as rivets and nut-and-bolt fasteners, or other attachment mechanisms. The physical and electrical characteristics of the gap 721 and non-conductive member 725 are essentially identical to those of the gap 421 and non-conductive member 425 of the first embodiment.

The outer ends of the ties 707 protrude through the walls 703 of the seal and have openings 781 for receiving the wall supports 711. The wall supports 711 and openings 481 may have other shapes.

As in the previous two embodiments, each tie 709 desirably has a suitable marking 785 on the tie to indicate that it is a non-conducting tie, thus differentiating it from the prior art conductive ties.

FIGS. 9A-9D illustrate a fifth embodiment of a mine seal, generally designated 801, made in accordance with this invention. The seal comprises two spaced apart walls 803 each made of extensible and contractible panels 805, non-conductive ties 809 extending between the walls 803 and holding them in place against forces tending to separate the walls, and a filler material 811 filling the space between the walls. The walls panels 805 are connected by wall supports 813 comprising, in this embodiment, a plurality of horizontal bars (e.g., angle bars) extending on the outside of the walls 603.

The filler material 811 can be full-weight concrete, foamed concrete, or other suitable material, such as described in U.S. Pat. No. 5,167,474.

Figure 9A:
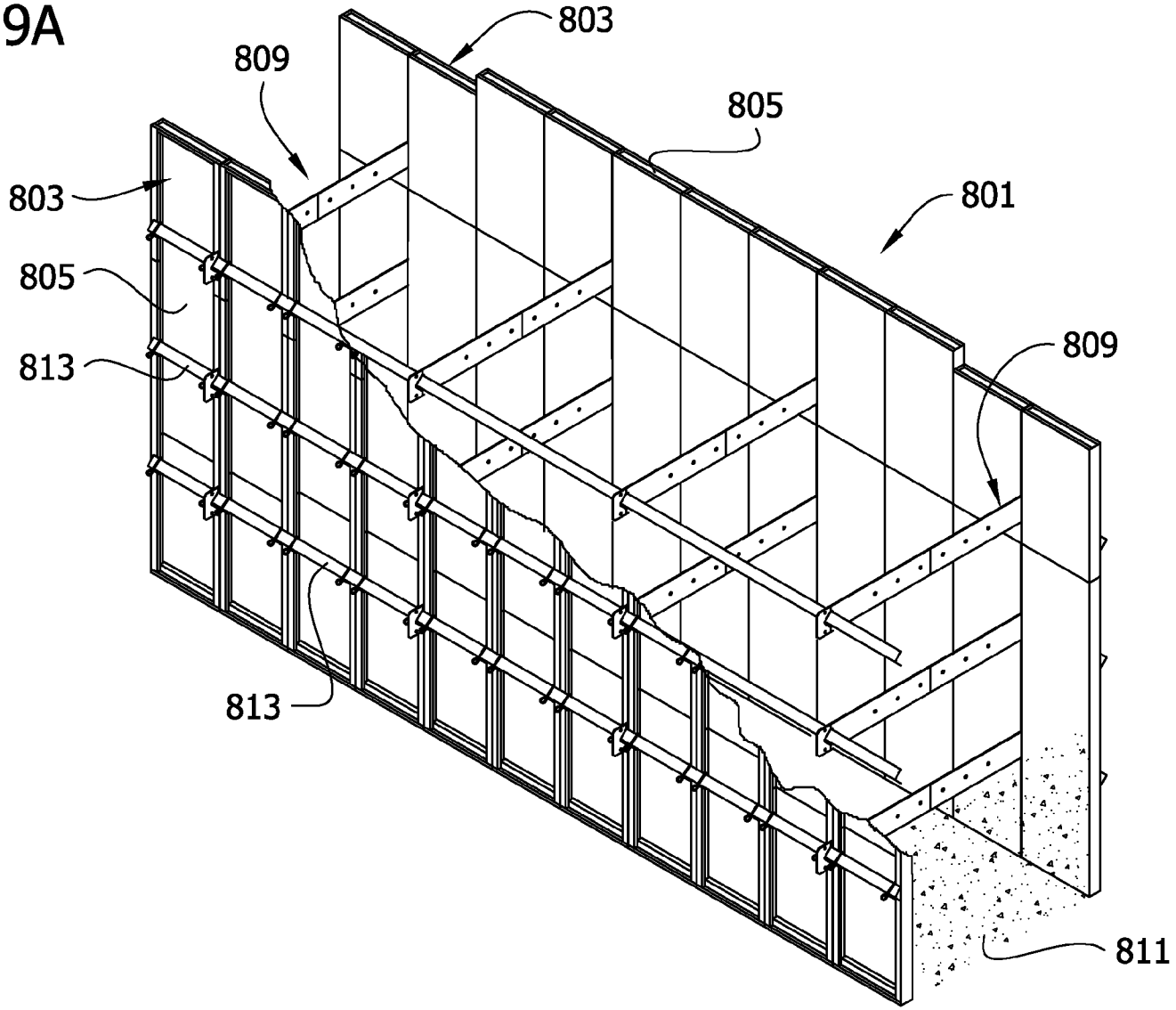
FIGS. 9A-9D show a fifth embodiment of a mine seal of this invention.
Figure 9B:
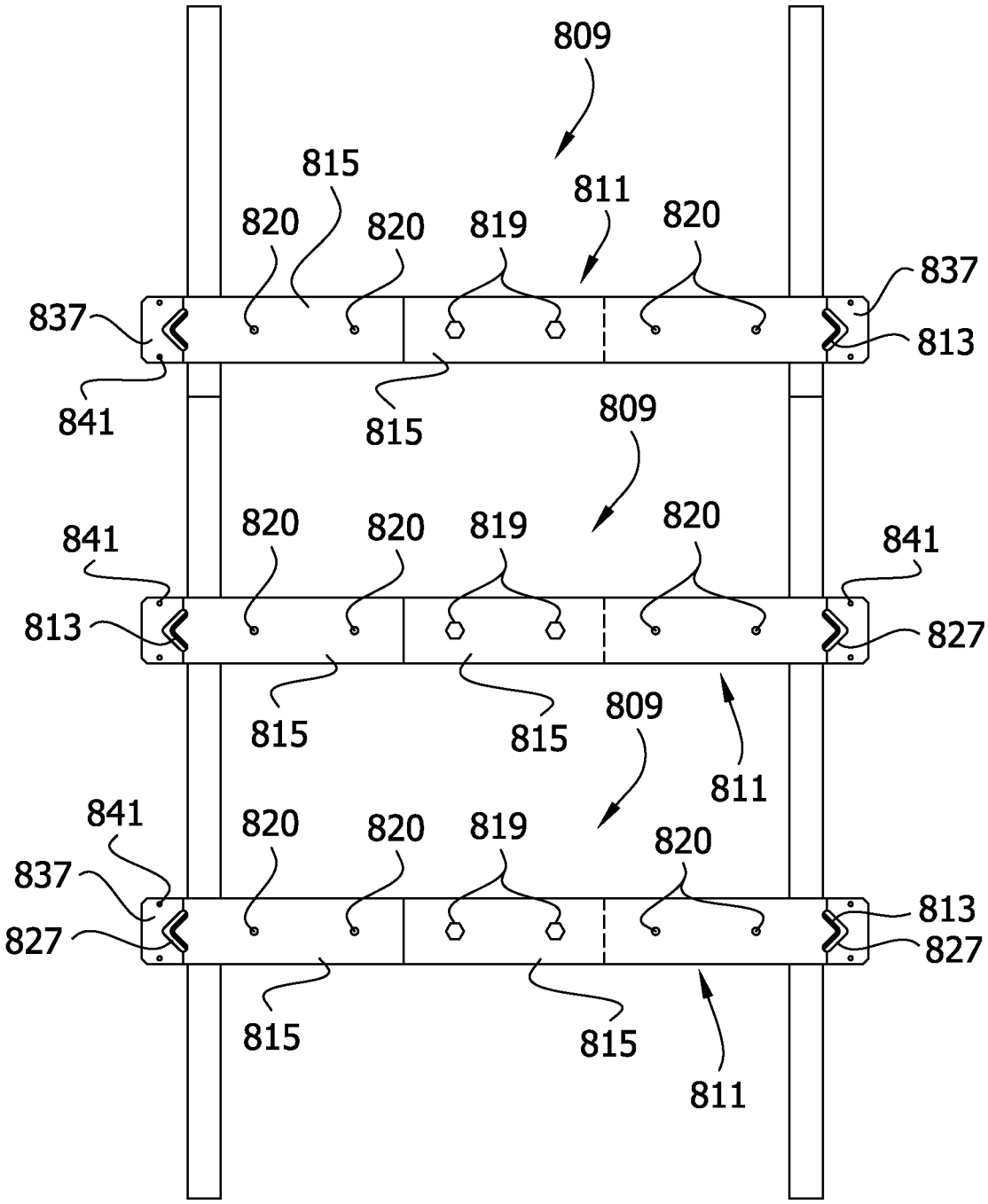
Figure 9C:
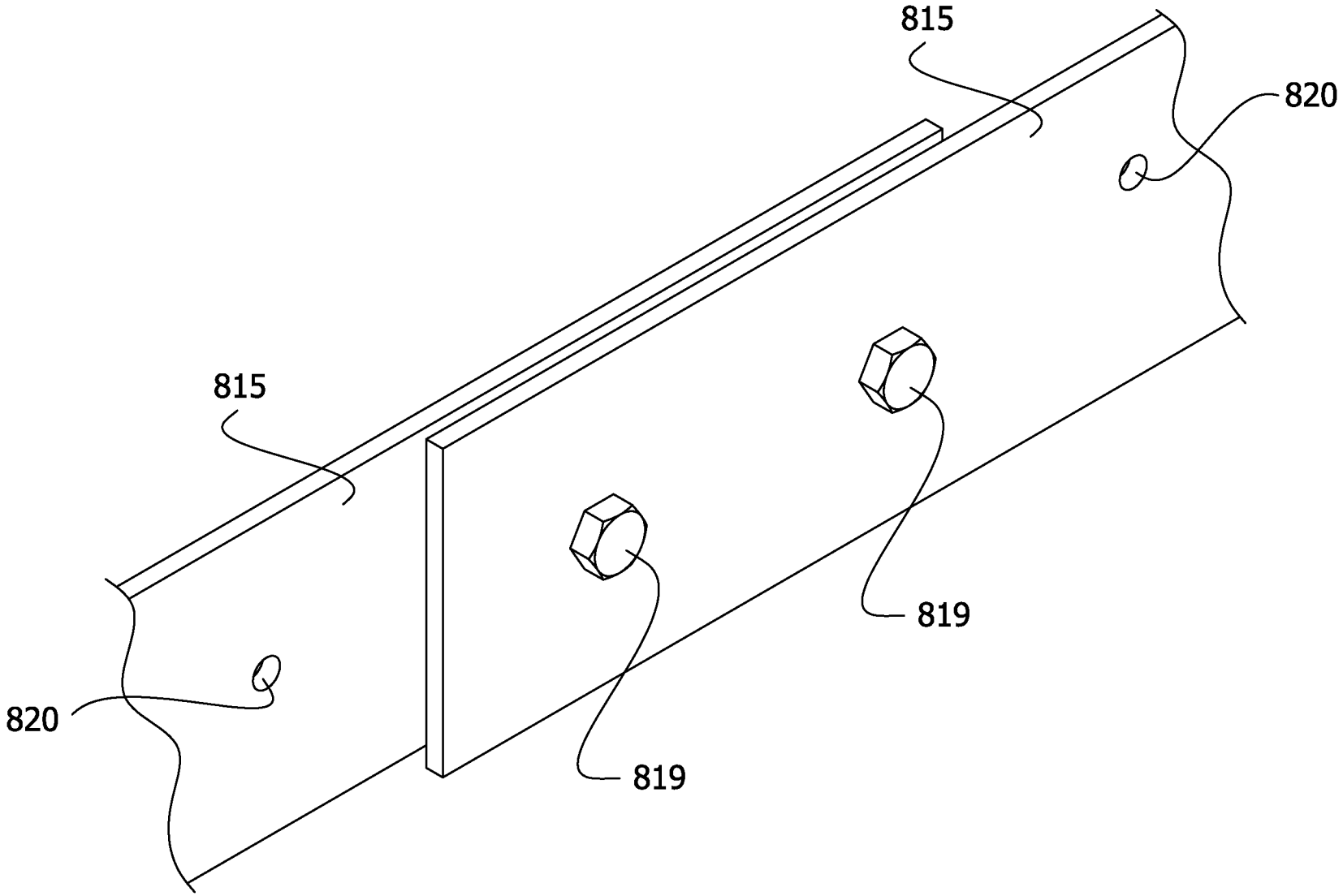
Figure 9D:
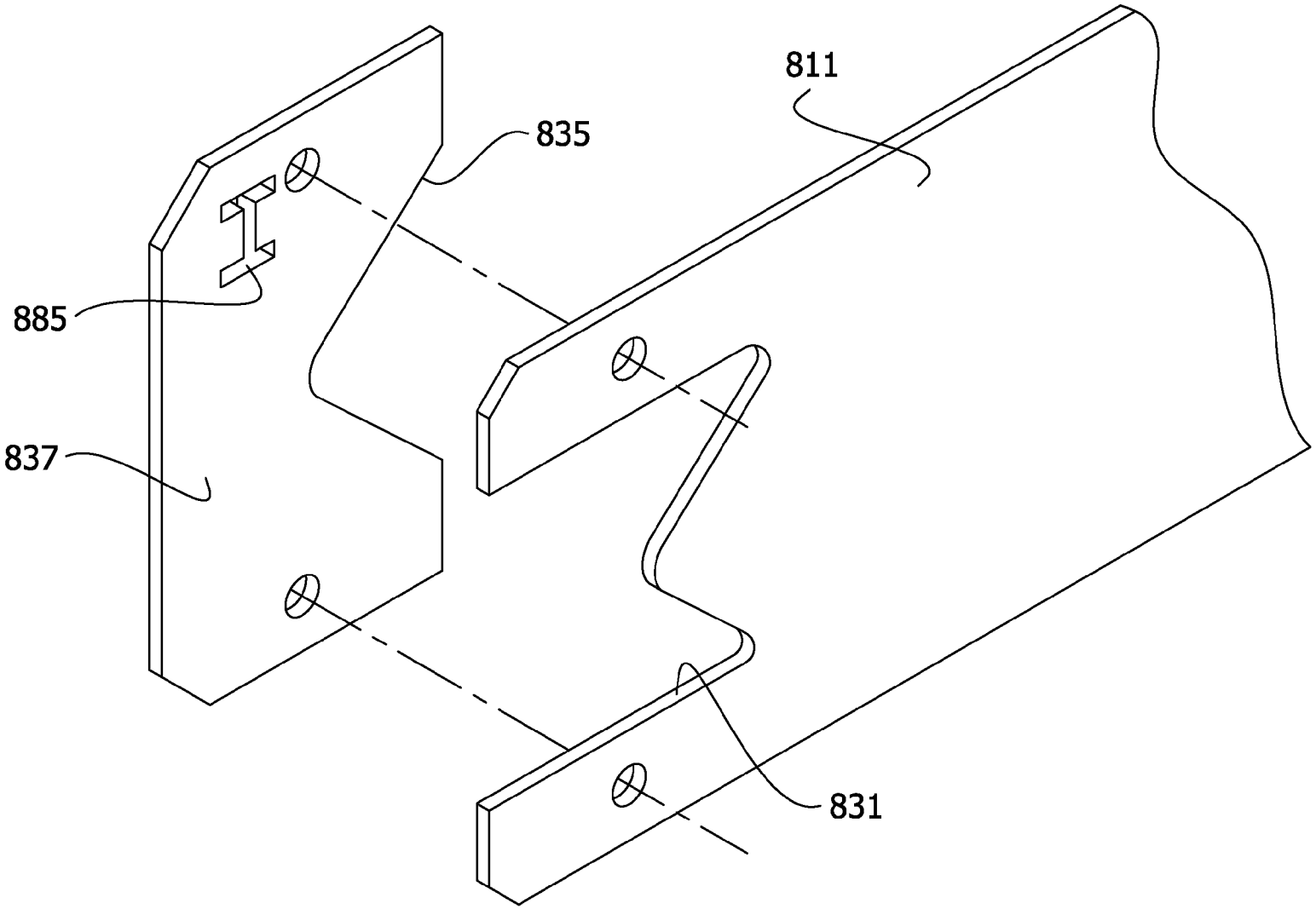

In this embodiment, each tie 809 comprises an adjustable-length elongate plate or bar 811 comprising a plurality of overlapping sections 815 secured together by suitable fasteners 819, e.g., nut-and-bolt fasteners, extending through selectively aligned holes 820 in the overlapping sections 815 (FIG. 9C). The overlapping sections 815 are made entirely or substantially entirely of an electrically non-conductive material (such as the non-conductive material described in previous embodiments) to prevent the conduction of electrical current through the mine seal along the tie. In one embodiment, the fasteners are of metal. In another embodiment, the fasteners are of an electrically non-conductive material.

The tie 809 has two openings 827 adjacent opposite ends of the tie 809 for receiving the wall supports 813. Each opening 827 is formed by the combination of a notch 831 in a respective end of the bar 811 and a mating notch 835 in an end section 837 of the tie. Two end sections 837 are secured to respective ends of the bar 811 by suitable fasteners 841 (e.g., metal nut-and-bolt fasteners or rivets). The openings 827 can be formed in other ways and have other shapes. In one embodiment, the end sections 837 are of metal. Alternatively, the end sections 837 may be of an electrically non-conductive material.

As in the previous two embodiments, each tie 809 desirably has a suitable marking 885 on the tie to indicate that it is a non-conducting tie, thereby differentiating it from the prior art conductive ties.

It will be noted that the insulating gap (e.g., 421, 521, 621, 721) described in previous embodiments can be located anywhere along the length of the tie (e.g., 409, 509, 609, 707) so long as the gap is between the side walls of the mine seal. Further, there may be more than one insulating gap (and associated electrically non-conductive member spanning the gap) along the length of the tie. To prevent the conduction of electrical current along the tie, the insulating gap should extend across substantially the entire width of the tie, and desirably across the entire width of the tie.

The lengths of the ties described above will depend on the depth of thickness of the seal itself. In general, however, the length of a tie will vary from four feet or less to ten feet or more.

Having described the invention in detail, it will be apparent that modifications and variations are possible without departing from the scope of the invention defined in the appended claims. By way of example, a non-conductive tie of this invention can be made entirely from a suitable electrically non-conductive material (e.g., of the types discussed previously), thereby eliminating the need for a separate non-conductive member. In some embodiments, the end sections of the tie located outboard of the walls of the seal (e.g., end sections 837 in FIGS. 9B and 9D) are made from metal and the remainder of the tie is made entirely or substantially entirely from an electrically non-conductive material. If the portion of the tie between the walls of the seal comprises more than one section of an electrically non-conductive material (e.g., FIG. 9B), the fasteners (e.g., nut-and-bolt fasteners 819 in FIG. 9B) holding the sections together may be made of metal or of an electrically non-conductive material.

This invention is also directed to a form for making a mine seal of this invention. The form comprises a plurality of wall panels (e.g., 405, 505, 605, 705, 805) adapted to be installed as walls in spaced apart relation for defining a space for receiving a filler material, and at least one electrically non-conductive tie (e.g., 409, 509, 609, 707, 809) adapted to extend between the walls and to hold them in place against forces tending to separate the walls. Desirably, the form also includes wall supports (415, 515, 613, 711, 813) secured to the ties. Once the form is in place, filler material is deposited between the walls and allowed to cure to form the mine seal. Various embodiments of a form of this invention are shown in the Figures and described above.

When introducing elements of the present invention or the preferred embodiments(s) thereof, the articles "a", "an", "the" and "said" are intended to mean that there are one or more of the elements. The terms "comprising", "including" and "having" are intended to be inclusive and mean that there may be additional elements other than the listed elements.

In view of the above, it will be seen that the several objects of the invention are achieved and other advantageous results attained.

As various changes could be made in the above constructions without departing from the scope of the invention, it is intended that all matter contained in the above description and shown in the accompanying drawings shall be interpreted as illustrative and not in a limiting sense.

What is claimed is:

1. A mine seal comprising two spaced apart walls, at least one electrically non-conductive tie extending between the walls and holding the walls in place against forces tending to separate the walls, and a filler material filling a space between the walls, and wherein the at least one non-conductive tie has a dielectric strength such that electrical current due to lightning is not conducted across the seal through the at least one tie, and wherein said at least one electrically non-conductive tie is a metal tie having opposite ends, said at least one tie further comprising an insulating gap in the metal tie preventing the conduction of electrical current between the ends of the tie, and an electrically non-conductive member spanning the insulating gap.

2. The mine seal as set forth in claim 1 further comprising fasteners for attaching the non-conductive member to said metal tie on opposite sides of the insulating gap.

3. The mine seal as set forth in claim 1 wherein said insulating gap and non-conductive member are surrounded by said filler material.

4. The mine seal as set forth in claim 3 wherein said filler material comprises concrete, and wherein said insulating gap has a dimension lengthwise of the at least one tie which is at least 0.5 in. to avoid bridging of the insulating gap by aggregate in the concrete.

5. A mine seal comprising two spaced apart walls, at least one electrically non-conductive tie extending between the walls and holding the walls in place against forces tending to separate the walls, and a filler material filling a space between the walls, and wherein the at least one non-conductive tie has a dielectric strength such that electrical current due to lightning is not conducted across the seal through the at least one tie, and wherein said at least one tie is made entirely or substantially entirely of an electrically non-conductive material except for metal end sections of the at least one tie located outboard of the walls of the seal.

6. A mine seal comprising two spaced apart walls, at least one electrically non-conductive tie extending between the walls and holding the walls in place against forces tending to separate the walls, and a filler material filling a space between the walls, and wherein the at least one non-conductive tie has a dielectric strength such that electrical current due to lightning is not conducted across the seal through the at least one tie, and wherein said at least one tie comprises a plurality of overlapping tie sections of an electrically non-conductive material, said overlapping tie sections being connected by one or more metal fasteners.

7. The mine seal as set forth in claim 6 wherein said at least one tie further comprises end sections located outboard of the walls of the seal, said end sections of the at least one tie being made of metal.

8. The mine seal as set forth in claim 7 wherein said metal end sections combine with said tie sections of electrically non-conductive material to define openings for receiving wall supports.

9. A form for a mine seal, comprising a plurality of wall panels adapted to be installed as walls in spaced apart relation for defining a space for receiving a filler material, and at least one electrically non-conductive tie adapted to extend between the walls and to hold the walls in place against forces tending to separate the walls, and wherein the at least one con-conductive tie has a dielectric strength such that electrical current due to lightning is not conducted across the seal through the at least one tie, and wherein said at least one electrically non-conductive tie is a metal tie having opposite ends, an insulating gap in the at least one tie inhibiting conduction of electrical current between the ends of the at least one tie, and a non-conductive member spanning the insulating gap.

10. The form as set forth in claim 9 further comprising fasteners for attaching the non-conductive member to said metal tie on opposite sides of the insulating gap.

11. A form for a mine seal, comprising a plurality of wall panels adapted to be installed as walls in spaced apart relation for defining a space for receiving a filler material, and at least one electrically non-conductive tie adapted to extend between the walls and to hold the walls in place against forces tending to separate the walls, and wherein the at least one con-conductive tie has a dielectric strength such that electrical current due to lightning is not conducted across the seal through the at least one tie, and wherein said at least one tie is made entirely or substantially entirely of an electrically non-conductive material except for metal end sections of the at least one tie located outboard of the walls of the seal.

12. A mine seal comprising two spaced apart walls, at least one electrically non-conductive tie extending between the walls and holding the walls in place against forces tending to separate the walls, and a filler material filling a space between the walls, and wherein the at least one non-conductive tie has a dielectric strength such that electrical current is not conducted across the seal through the at least one tie, and wherein said at least one electrically non-conductive tie is a metal tie having opposite ends, said at least one tie further comprising an insulating gap in the metal tie preventing the conduction of electrical current between the ends of the tie, and an electrically non-conductive member spanning the insulating gap.

* * * * *